US008240061B2

(12) United States Patent
Nakada et al.

(10) Patent No.: US 8,240,061 B2
(45) Date of Patent: Aug. 14, 2012

(54) SURFACE TREATMENT APPARATUS

(75) Inventors: Hideki Nakada, Hirakata (JP); Kouhei Kohama, Hirakata (JP); Tetsuro Uemura, Hirakata (JP); Takashi Sato, Hirakata (JP); Ryosuke Hamada, Hirakata (JP)

(73) Assignee: C. Uyemura & Co., Ltd., Osaka-shi (JP)

( * ) Notice: Subject to any disclaimer, the term of this patent is extended or adjusted under 35 U.S.C. 154(b) by 0 days.

(21) Appl. No.: 13/195,053

(22) Filed: Aug. 1, 2011

(65) Prior Publication Data

US 2012/0017458 A1 Jan. 26, 2012

Related U.S. Application Data

(62) Division of application No. 12/361,230, filed on Jan. 28, 2009, now Pat. No. 8,015,983.

(30) Foreign Application Priority Data

Feb. 1, 2008 (JP) ..... 2008-023076

(51) Int. Cl.
*F26B 11/22* (2006.01)

(52) U.S. Cl. ..... 34/132; 134/102.3

(58) Field of Classification Search ..... 134/122 R, 134/64 R, 102.3; 34/201
See application file for complete search history.

(56) References Cited

U.S. PATENT DOCUMENTS 2,036,261 A 4/1936 Dinely
3,229,701 A 1/1966 Sadwith
3,318,018 A * 5/1967 Lake et al. ..... 34/62
3,910,297 A 10/1975 Pinkham
3,955,286 A * 5/1976 Anrep ..... 34/263
4,039,350 A * 8/1977 Bucy et al. ..... 134/22.17
4,233,083 A 11/1980 Roberts
5,377,704 A 1/1995 Huddle
5,477,623 A * 12/1995 Tomizawa et al. ..... 34/58
5,653,820 A 8/1997 Higashino
5,879,520 A 3/1999 Griego
5,970,624 A * 10/1999 Moriya ..... 34/411
6,321,760 B1 * 11/2001 Meissner ..... 134/80
6,343,610 B1 2/2002 Berger et al.
6,829,844 B2 * 12/2004 Brady et al. ..... 34/381
6,868,621 B1 * 3/2005 Grimm et al. ..... 34/92
6,913,650 B2 * 7/2005 Gilmore et al. ..... 118/66
(Continued)

FOREIGN PATENT DOCUMENTS

JP 08-020445 1/1996
(Continued)

*Primary Examiner* — Frankie L Stinson
(74) *Attorney, Agent, or Firm* — Crowell & Moring LLP

(57) ABSTRACT

The surface treatment apparatus includes: a supply device for supplying an introduced workpiece to the inside of a treatment cell of a subsequent surface treatment device; a surface treatment device for supplying a surface treatment liquid to the inside of the treatment cell while rotating the treatment cell, thereby performing a surface treatment on the workpiece; a workpiece collection device for inverting the treatment cell, and squirting the inside of the treatment cell with water from below to flow out the workpiece, thereby collecting the workpiece into a collection vessel; a drying device for receiving the collection vessel from the workpiece collection device, and exposing the workpiece within the collection vessel to air, thereby drying the workpiece; and a carrying device for carrying the treatment cell between the surface treatment devices, and between the surface treatment device and the workpiece device, wherein the surface treatment apparatus includes the one or more surface treatment devices.

1 Claim, 20 Drawing Sheets

U.S. PATENT DOCUMENTS

| | | | |
|---|---|---|---|
| 7,270,134 | B2 | 9/2007 | Muller et al. |

FOREIGN PATENT DOCUMENTS

| | | | |
|---|---|---|---|
| JP | 08-224164 | | 9/1996 |
| JP | 11-505295 | A | 5/1999 |
| JP | 2001-073175 | | 3/2001 |
| JP | 2003-054758 | | 2/2003 |
| WO | WO 96/37638 | A1 | 11/1996 |

* cited by examiner

SURFACE TREATMENT APPARATUS

CROSS REFERENCE TO RELATED APPLICATIONS

The present application is a divisional application of U.S. patent application Ser. No. 12/361,230, filed Jan. 28, 2009, and claims priority under 35 U.S.C. §119 to Japanese Patent Application No. 2008-023076, filed Feb. 1, 2008, the entire disclosures of which are herein expressly incorporated by reference.

TECHNICAL FIELD

The present invention relates to a surface treatment apparatus for sequentially carrying a treatment cell containing a workpiece to a series of devices for operations in the respective devices, thereby obtaining a surface-treated workpiece. Examples of workpieces include small objects (small components) such as a powdery work, a chip capacitor, a diode, a connector, a reed switch, a nail, a bolt, a nut, and a washer, each having a size of 0.5 to 5000 μm. Furthermore, surface treatments include an electroplating process using nickel, tin, etc., for example.

BACKGROUND ART

As surface treatment apparatuses for surface-treating workpieces, apparatuses disclosed in Patent Documents 1 and 2, for example, are known. In each of these apparatuses, in a state where a treatment cell is placed on a receiving plate, the surface treatment and/or water washing of a workpiece are/is performed, or the cleaning or the like of the treatment cell is carried out.

[Patent Document 1]

Published Patent Application, Japanese Translation of PCT Internal Application No. 11-505295.

[Patent Document 2]

U.S. Pat. No. 5,879,520.

DISCLOSURE OF THE INVENTION

Problems to be Solved by the Invention

However, in each of the above-mentioned conventional apparatuses, since various processes such as a surface treatment and a water washing process are carried out by a single apparatus, the efficiency is low, and furthermore, the respective processes themselves might be insufficient.

Therefore, there have been demands for a surface treatment apparatus capable of carrying out a surface treatment, a water washing process, a drying process, etc. automatically in an assembly line manner and in a space-saving installation area.

Solution to the Problems

A first invention of the present application provides a surface treatment apparatus for sequentially carrying an introduced workpiece to a series of devices for operations in the respective devices, thereby obtaining the surface-treated workpiece, wherein the surface treatment apparatus includes:

a supply device for supplying the introduced workpiece to the inside of a treatment cell of a subsequent surface treatment device;

a surface treatment device for supplying a surface treatment liquid to the inside of the treatment cell while rotating the treatment cell, thereby performing a surface treatment on the workpiece;

a workpiece collection device for inverting the treatment cell, and squirting the inside of the treatment cell with water from below to flow out the workpiece, thereby collecting the workpiece into a collection vessel;

a drying device for receiving the collection vessel from the workpiece collection device, and exposing the workpiece within the collection vessel to air, thereby drying the workpiece; and;

a carrying device for carrying the treatment cell between the surface treatment devices, and between the surface treatment device and the workpiece collection device, and wherein the surface treatment apparatus includes the one or more surface treatment devices.

A second invention of the present application provides a supply device for supplying an introduced workpiece to a subsequent device, wherein the supply device includes: an introduction vessel for storing the introduced workpiece; a supporting member for supporting the introduction vessel; movement means for moving the introduction vessel horizontally via the supporting member; and raising and lowering means for moving the introduction vessel vertically via the supporting member, and wherein the supply device is formed so as to move the introduction vessel horizontally and vertically, thereby allowing an openable/closable introduction port at a lower part of the introduction vessel to be located at a predetermined position of the subsequent device.

A third invention of the present application provides a surface treatment device for supplying a surface treatment liquid to the inside of a treatment cell while rotating the treatment cell containing a workpiece, thereby performing a surface treatment on the workpiece, wherein the surface treatment device includes positive electrode supporting means for supporting a positive electrode so that the positive electrode can be used for a surface treatment, wherein the positive electrode supporting means includes a positive electrode retaining tank for retaining the positive electrode, and wherein the positive electrode retaining tank contains the surface treatment liquid so that the positive electrode is immersed therein.

A fourth invention of the present application provides a surface treatment device for supplying a surface treatment liquid to the inside of a treatment cell while rotating the treatment cell containing a workpiece, thereby performing a surface treatment on the workpiece, wherein the surface treatment device includes positive electrode supporting means for supporting a positive electrode so that the positive electrode can be used for a surface treatment, wherein the positive electrode supporting means includes:

a positive electrode supporting member for supporting the positive electrode;

a tray supporting member for supporting a positive electrode tray;

raising and lowering means for moving the positive electrode vertically via the positive electrode supporting member;

positive electrode moving means for moving the positive electrode horizontally via the positive electrode supporting member;

tray moving means for moving the positive electrode tray horizontally via the tray supporting member; and connecting means through which the positive electrode supporting member and the tray supporting member are connected to each other, and wherein the connecting means is formed so as to connect both the supporting members when the positive electrode starts moving from above a positive electrode retaining tank or from above the treatment cell by the positive electrode moving means and when the positive electrode tray is located below the positive electrode by the tray moving means.

A fifth invention of the present application provides a workpiece collection device for collecting a surface-treated workpiece within a treatment cell, wherein the workpiece collection device includes:

a receiving plate on which the treatment cell is placed;

a hopper for covering the treatment cell placed on the receiving plate;

inverting means for inverting both of the treatment cell placed on the receiving plate, and the hopper;

cleaning water supply means for squirting the inside of the inverted treatment cell with a cleaning water;

a collection vessel for collecting the workpiece, which has been flowed out of the treatment cell with the cleaning water, by filtering out the workpiece by a filter member;

raising and lowering means for raising the collection vessel so as to close a discharge port of the inverted hopper by the collection vessel from below; and a collection tank for receiving the used cleaning water, wherein the hopper has a lid member for closing the discharge port from inside, wherein the lid member is urged toward the discharge port from inside, wherein the raising and lowering means is formed so as to vertically move a cylindrical body surrounding the collection vessel, wherein the cylindrical body internally has a receiving portion that abuts against the collection vessel to lift the collection vessel, and wherein the lid member is formed so as to open the discharge port by being pushed up by the collection vessel.

A sixth invention of the present application provides a drying device for exposing a workpiece contained in a collection vessel to air, thereby drying the workpiece, wherein the drying device includes:

a receiving plate on which the collection vessel is placed;

a hood for hermetically closing, from above and below, the collection vessel placed on the receiving plate; and air supply and exhaust means for supplying air to and exhausting air from the inside of the hood, wherein the receiving plate has a through hole at its portion that faces a filter member constituting a bottom of the collection vessel, and wherein the air supply and exhaust means has: a blower for delivering air; a supply pipe through which air from the blower is supplied to a region located above the receiving plate; and an exhaust pipe through which air is exhausted from below the receiving plate.

Effects of the Invention

In the surface treatment apparatus according to the first invention of the present application, the workpiece, which has been introduced into the supply device by an operator, is automatically carried to the surface treatment device, the workpiece collection device, and the drying device in sequence, thereby making it possible to obtain the surface-treated and dried workpiece. Moreover, this effect can be achieved by utilizing the devices within the single apparatus. Accordingly, the surface treatment apparatus of the present invention is capable of carrying out a surface treatment, a water washing process, a drying process, etc. automatically in an assembly line manner and in a space-saving installation area.

In the supply device according to the second invention of the present application, the workpiece introduced by an operator can be automatically introduced into the treatment cell set in the subsequent device, and the operation efficiency can accordingly be improved.

In the surface treatment device according to the third invention of the present invention, the positive electrode can be immersed in the surface treatment liquid contained in the positive electrode retaining tank during a non-operation period, and therefore, the degradation of the positive electrode can be prevented.

In the surface treatment device according to the fourth invention of the present application, when the positive electrode is moved between a position located above the positive electrode retaining tank and a position located above the treatment cell, the positive electrode tray can be located below the positive electrode and moved together with the positive electrode; therefore, the surface treatment liquid dripping down from the positive electrode can be received by the positive electrode tray. Accordingly, the contamination of the periphery of the surface treatment device by the surface treatment liquid can be prevented.

In the workpiece collection device according to the fifth invention of the present application, the workpiece within the treatment cell placed on the receiving plate can be automatically collected into the collection vessel.

In the drying device according to the sixth invention of the present application, the air from the blower passes through the collection vessel with certainty. In other words, the workpiece within the collection vessel can be exposed to the air from the blower with certainty. Accordingly, the workpiece can be dried with reliability. Moreover, since the air passes through the collection vessel from the top to the bottom, the workpiece is pressed downward. Accordingly, the scattering of the workpiece during operation can be prevented.

BEST MODE FOR CARRYING OUT THE INVENTION

Hereinafter, an embodiment of a surface treatment apparatus of the present invention will be described.

(A) First, a structure of the surface treatment apparatus of the present embodiment will be described.

(1) Overall Structure

Figure 1:
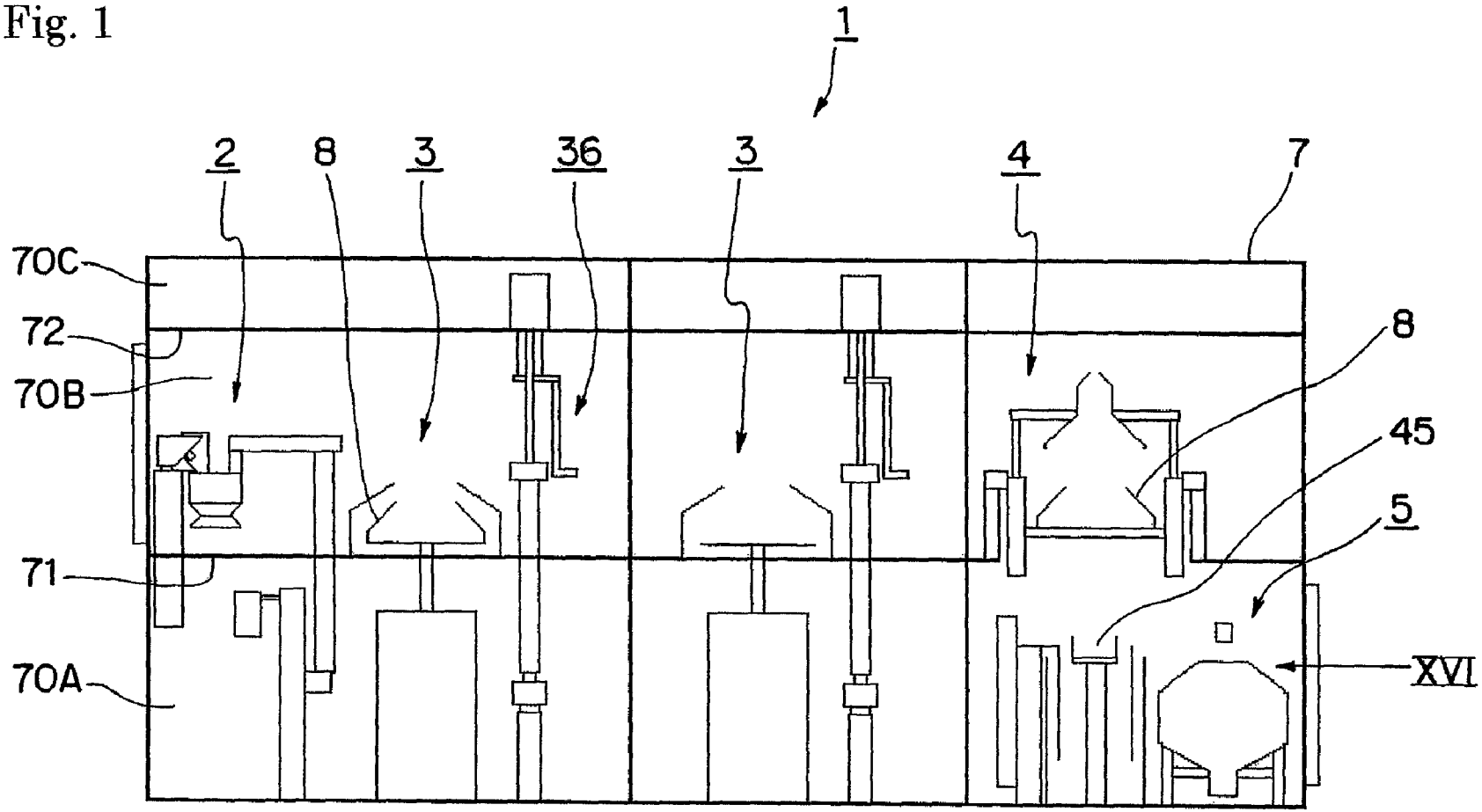
FIG. 1 is a front perspective view showing a surface treatment apparatus of one embodiment of the present invention.
Figure 2:
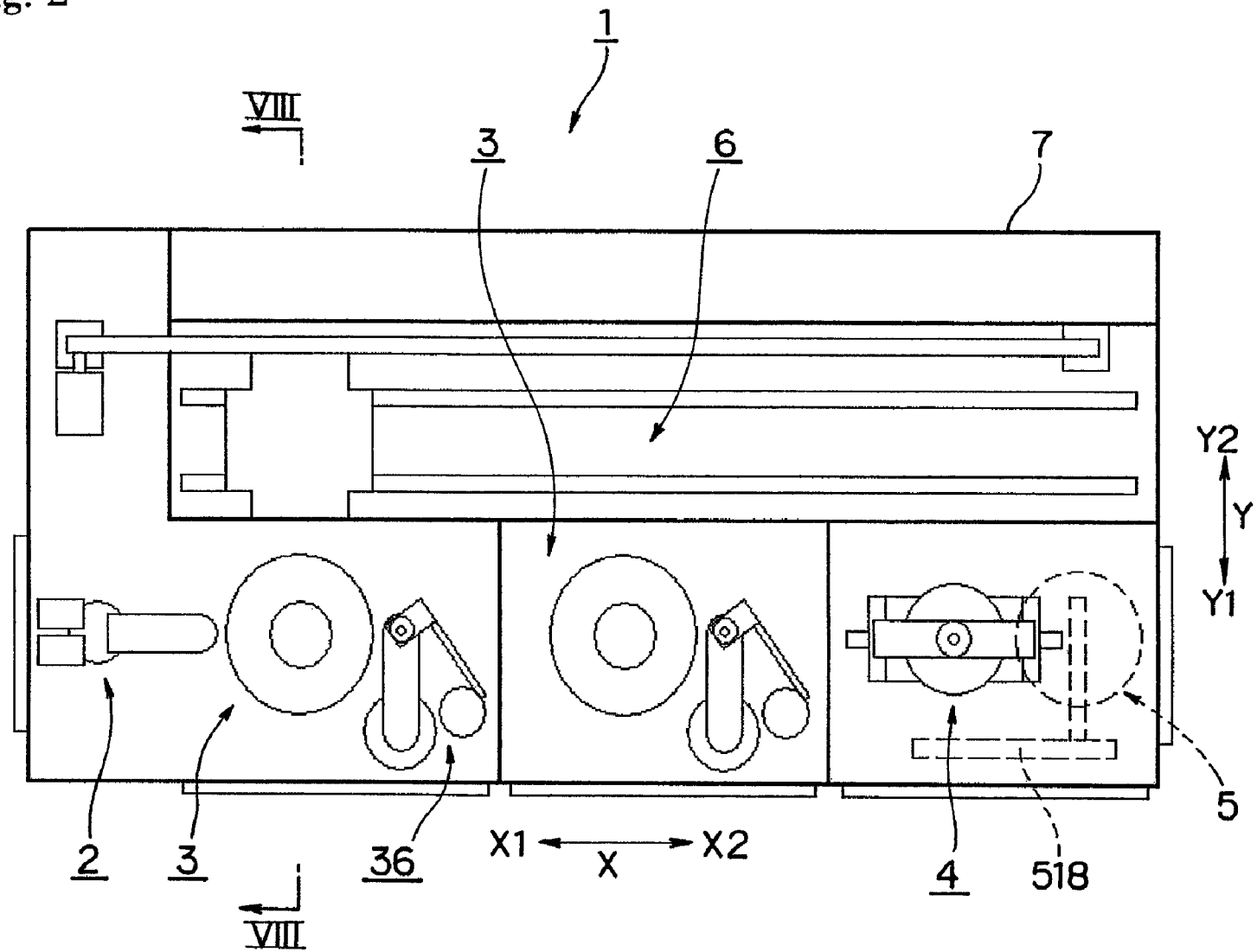
FIG. 2 is a plan perspective view of the apparatus of the present embodiment.

FIG. 1 is a front perspective view showing the surface treatment apparatus of the present embodiment. FIG. 2 is a plan perspective view of the surface treatment apparatus of the present embodiment. This surface treatment apparatus 1 serves as an apparatus for sequentially carrying an introduced workpiece to a series of devices for operations in the respective devices, thereby obtaining the surface-treated workpiece. The surface treatment apparatus 1 includes a supply device 2, two surface treatment devices 3, a workpiece collection device 4, a drying device 5, and a carrying device 6. In the surface treatment apparatus 1, all of these devices are contained in a single rectangular parallelepiped box body 7. The box body 7 has: a partition plate 71 through which an inner space is partitioned into two spaces, i.e., lower and upper spaces 70A and 70B; and a top plate 72 by which a ceiling space 70C is formed. The supply device 2, the two surface treatment devices 3, the workpiece collection device 4 and the drying device 5 are located within the box body 7 so as to be aligned at the front side thereof, while the carrying device 6 is located within the box body 7 at the back side thereof. A workpiece is a chip capacitor, for example. The surface treatment carried out by the first surface treatment device 3 is a nickel plating process, for example, and the surface treatment carried out by the second surface treatment device 3 is a tin plating process, for example.

The supply device 2 supplies an introduced workpiece to the inside of a treatment cell 8 of the subsequent surface treatment device 3. The surface treatment device 3 supplies a surface treatment liquid to the inside of the treatment cell 8 while rotating the treatment cell 8, thereby performing a surface treatment on the workpiece. The workpiece collection device 4 inverts the treatment cell 8, and squirts the inside of the treatment cell 8 with water from below to flow out the workpiece, thereby collecting the workpiece into a collection vessel 41. The drying device 5 receives the collection vessel 41 from the workpiece collection device 4, and exposes the workpiece within the collection vessel 41 to air, thereby drying the workpiece. The carrying device 6 carries the treatment cell 8 between the first surface treatment device 3 and the second surface treatment device 3, and carries the treatment cell 8 between the surface treatment devices 3 and the workpiece collection device 4.

(2) Supply Device 2

Figure 3:
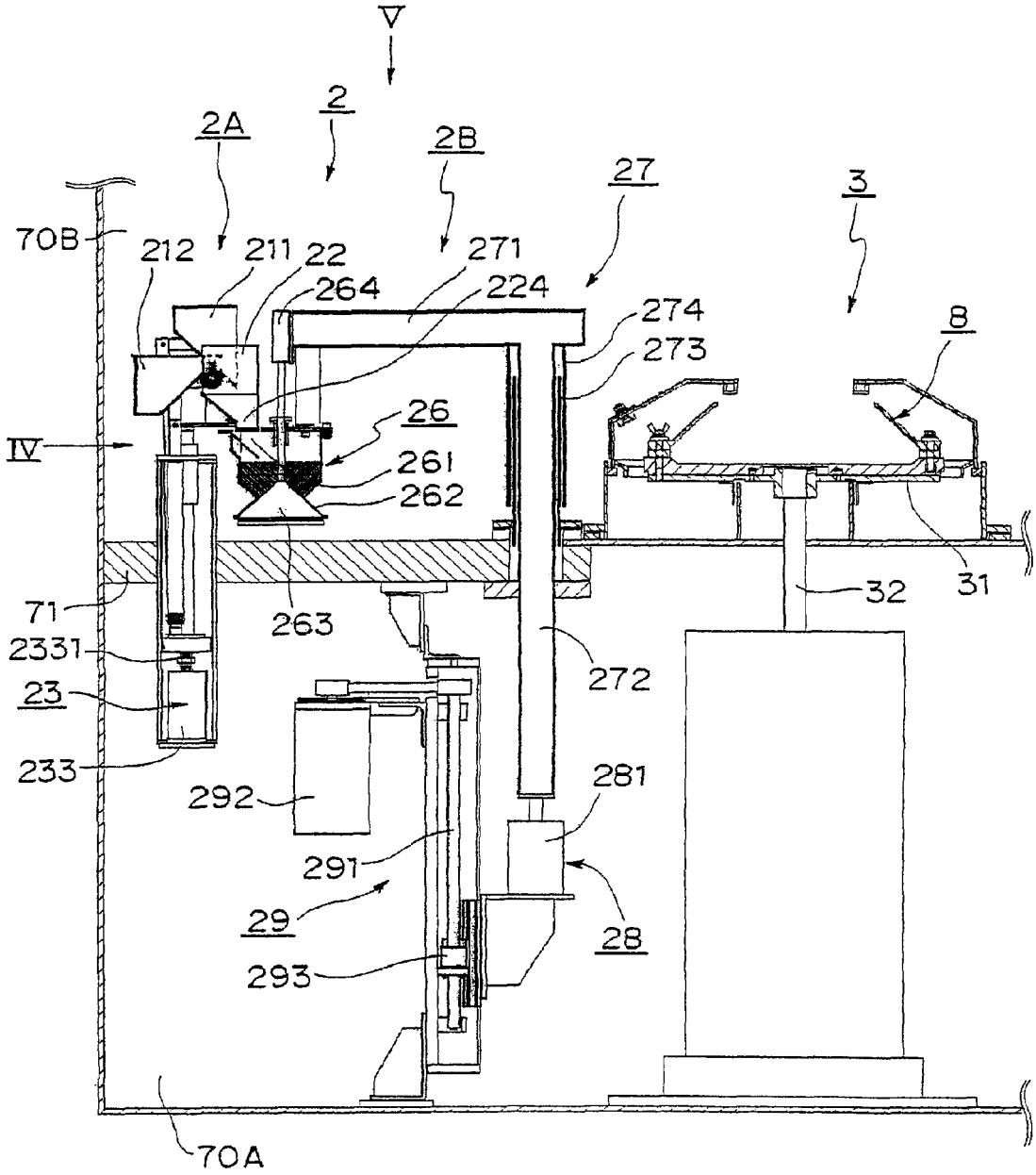
FIG. 3 is a front cross-sectional view showing a supplying device and a surface treatment device of the present embodiment.
Figure 4:
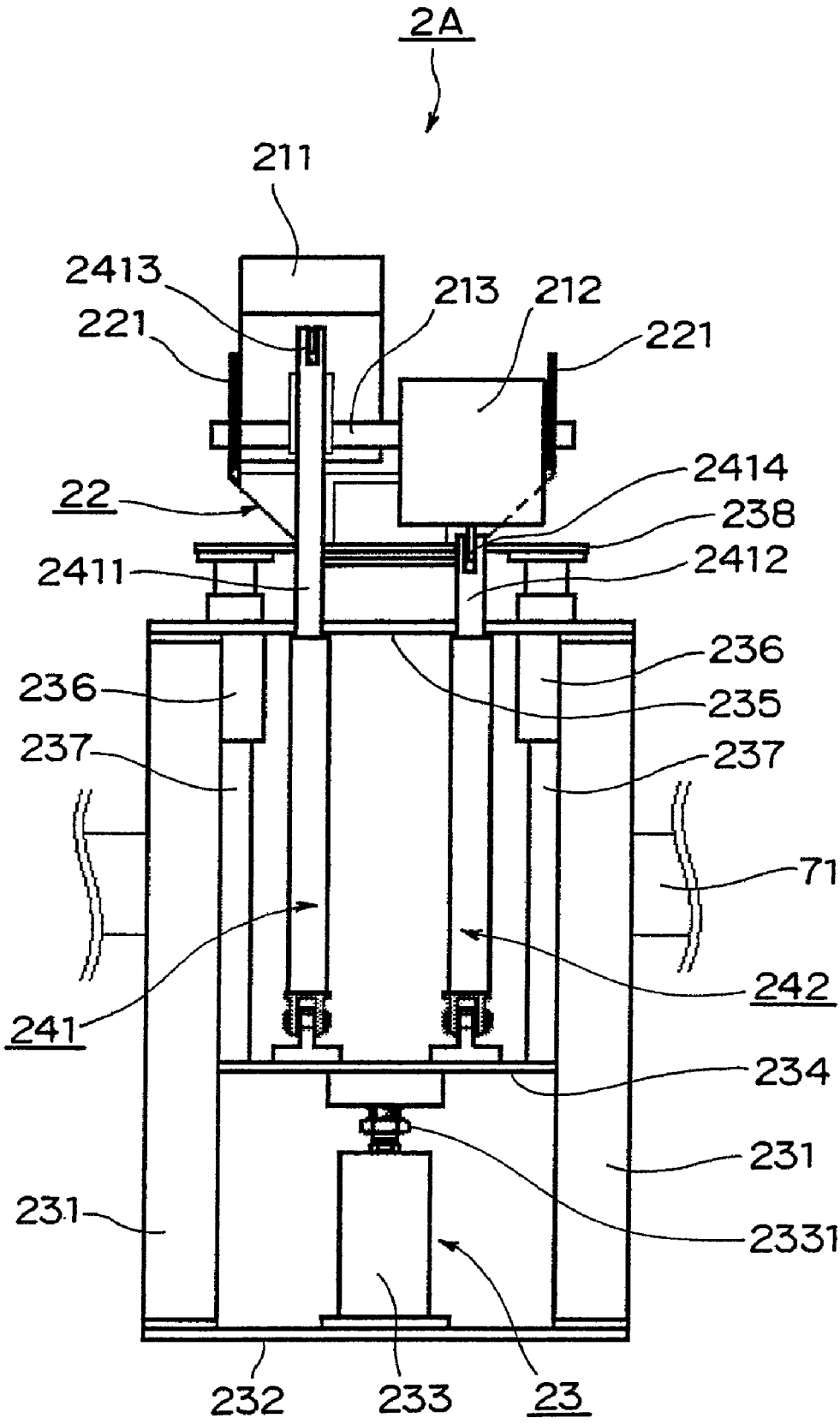
FIG. 4 is a diagram viewed from the arrow IV of FIG. 3, showing a first supply section.
Figure 5:
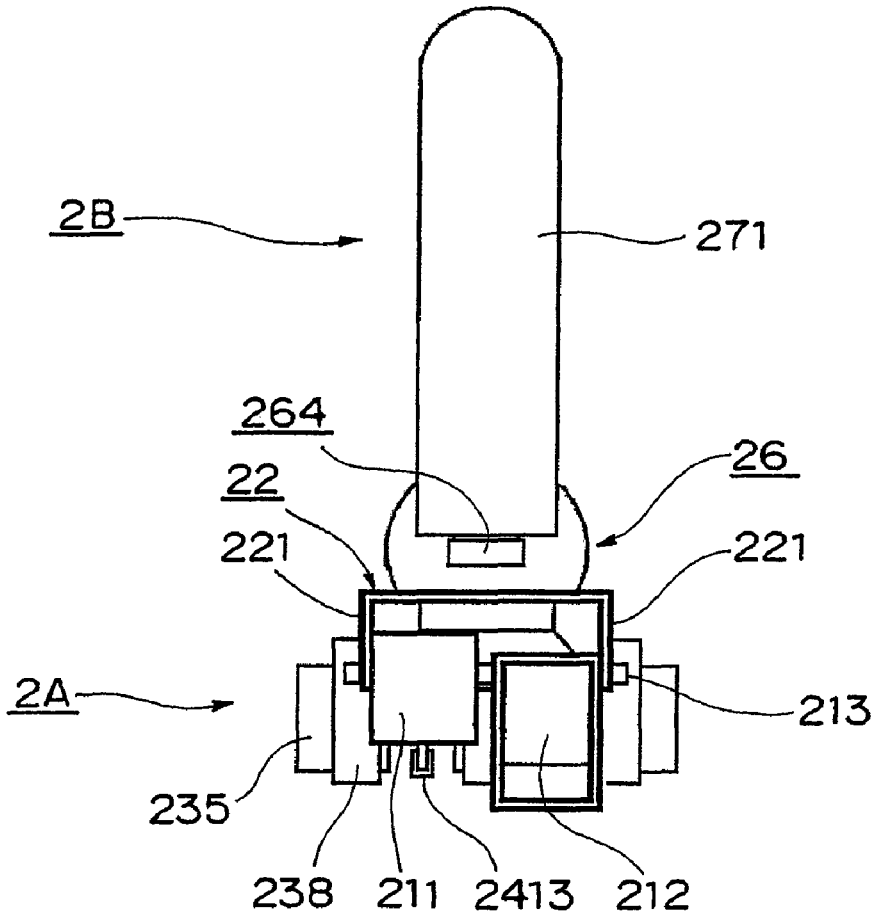
FIG. 5 is a diagram viewed from the arrow V of FIG. 3.

FIG. 3 is a front cross-sectional view showing the supply device 2 and the surface treatment device 3. The supply device 2 includes a first supply section 2A and a second supply section 2B. FIG. 4 is a diagram viewed from the arrow IV of FIG. 3, showing the first supply section 2A. FIG. 5 is a diagram viewed from the arrow V of FIG. 3.

(2-1) First Supply Section 2A

The first supply section 2A includes: a first shooter 211 for storing an introduced dummy; a second shooter 212 for storing an introduced workpiece; a hopper 22 for guiding the dummy discharged from the first shooter 211 or the workpiece discharged from the second shooter 212 to the subsequent stage; an overall raising and lowering means 23 for vertically moving both of the shooters 211 and 212 and the hopper 22; a first raising and lowering means 241 for vertically moving one end portion of the first shooter 211; and a second raising and lowering means 242 for vertically moving one end portion of the second shooter 212.

Both of the shooters 211 and 212 are supported between both walls 221 of the hopper 22 by a horizontal shaft 213, and are each allowed to be rotated around the horizontal shaft 213 when its one end portion is vertically moved.

As shown in FIG. 4 in particular, the overall raising and lowering means 23 is fixed to the horizontal partition plate 71 that is fixed to the box body 7. The overall raising and lowering means 23 includes: two parallel vertical rails 231 fixed to the partition plate 71; a horizontal plate 232 extended to lower ends of the two vertical rails 231; a vertical cylinder 233 fixed onto the horizontal plate 232; a horizontal plate 234 fixed to a rod 2331 of the cylinder 233; a horizontal plate 235 extended to upper ends of the two vertical rails 231; two vertical cylindrical rails 236 passing through the horizontal plate 235; two rods 237 extending perpendicularly from the horizontal plate 234 and slidable within the vertical cylindrical rails 236; and a horizontal plate 238 extended to upper ends of the two rods 237.

The hopper 22 is fixed to the horizontal plate 238. Accordingly, upon operation of the cylinder 233, the rod 2331 moves forward/backward, and the horizontal plate 234 is moved vertically together with the two rods 237 and the horizontal plate 238. As a result, the hopper 22 and both of the shooters 211 and 212 are vertically moved.

The first raising and lowering means 241 is a vertical cylinder fixed at its lower end to the horizontal plate 234, and a tip of a rod 2411 is connected to one end portion of the first shooter 211 so as to be rotatable via the horizontal shaft 2413. The second raising and lowering means 242 is a vertical cylinder fixed at its lower end to the horizontal plate 234, and a tip of a rod 2412 is connected to one end portion of the second shooter 212 so as to be rotatable via the horizontal shaft 2414. Accordingly, when the first raising and lowering means 241 is operated and the rod 2411 is extended, the first shooter 211 is rotated around the horizontal shaft 213, and the dummy stored in the first shooter 211 is discharged into the hopper 22. On the other hand, when the second raising and lowering means 242 is operated and the rod 2412 is extended, the second shooter 212 is rotated around the horizontal shaft 213, and the workpiece stored in the second shooter 212 is discharged into the hopper 22.

(2-2) Second Supply Section 2B

The second supply section 2B includes: a pot (introduction vessel) 26 for storing the workpiece and dummy guided through the hopper 22; a supporting member 27 for supporting the pot 26; a movement means 28 for horizontally moving the pot 26 via the supporting member 27; and a raising and lowering means 29 for moving the pot 26 vertically via the supporting member 27.

The supporting member 27 consists of a horizontal arm 271 and a vertical pole 272. The pot 26 is supported at a tip of the horizontal arm 271. The vertical pole 272 passes through the partition plate 71 from a base end of the horizontal arm 271, and extends downward therefrom. Above the partition plate 71, the vertical pole 272 is surrounded by an inner sleeve 273 extending upward from the partition plate 71, and an outer sleeve 274 extending downward from the horizontal arm 271. The inner sleeve 273 and the outer sleeve 274 are partially overlapped with each other even when the horizontal arm 271 is located at its upper limit position.

Figure 6:
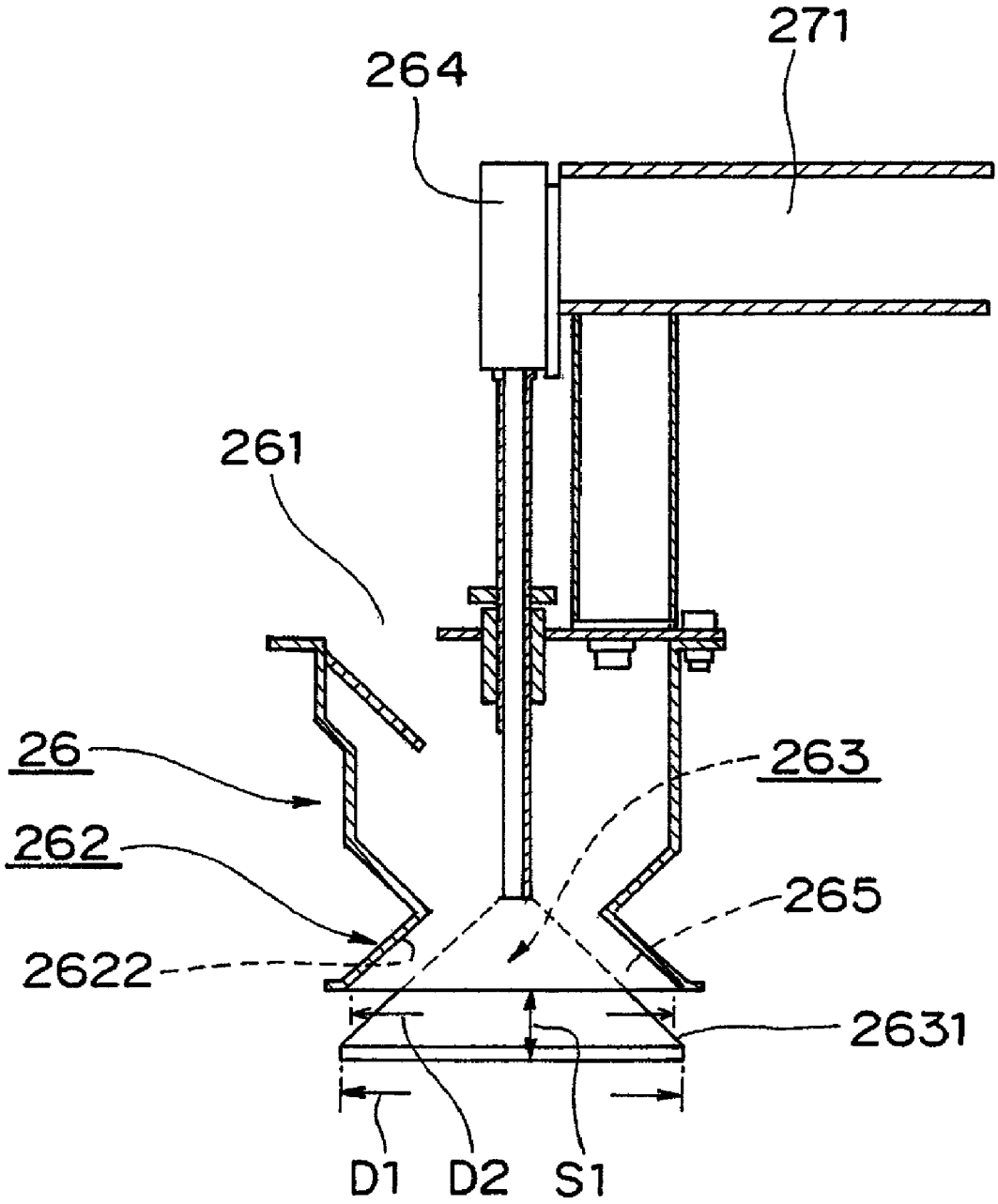
FIG. 6 is an enlarged cross-sectional view of a pot of the present embodiment.

As shown in FIG. 6, the pot 26 is a vessel having an inflow port 261 at a part of its upper face, and having a discharge portion 262 opened conically at its lower part. The discharge portion 262 is provided with a conical lid 263 for hermetically closing the discharge portion 262. A diameter D1 of the lid 263 is slightly larger than a diameter D2 of an opening 2621 of the discharge portion 262. The lid 263 abuts, at its outer face 2631, against an inner face 2622 of the discharge portion 262, thus closing the discharge portion 262. The lid 263 is allowed to be moved vertically by a vertical cylinder 264 fixed to the horizontal arm 271. In other words, the lid 263 is allowed to open and close the discharge portion 262 by the cylinder 264. A raising and lowering stroke S1 of the cylinder 264 is set at 1 to 10 mm.

The movement means 28 and the raising and lowering means 29 are provided in the space 70A located below the partition plate 71. The movement means 28 includes a rotation table 281. The rotation table 281 is provided at a lower end of the vertical pole 272, and axially rotates the vertical pole 272. Accordingly, upon operation of the rotation table 281, the horizontal arm 271 is rotated around the vertical pole 272, and the pot 26 is horizontally moved. The raising and lowering means 29 includes a vertical ball screw 291, and a motor 292 for rotating the ball screw 291. The rotation table 281 is attached to the ball screw 291 via a nut 293. Accordingly, upon operation of the motor 292, the ball screw 291 is rotated, and the rotation table 281 is vertically moved; as a result, the vertical pole 272, the horizontal arm 271, and the pot 26 are vertically moved.

Figure 7:
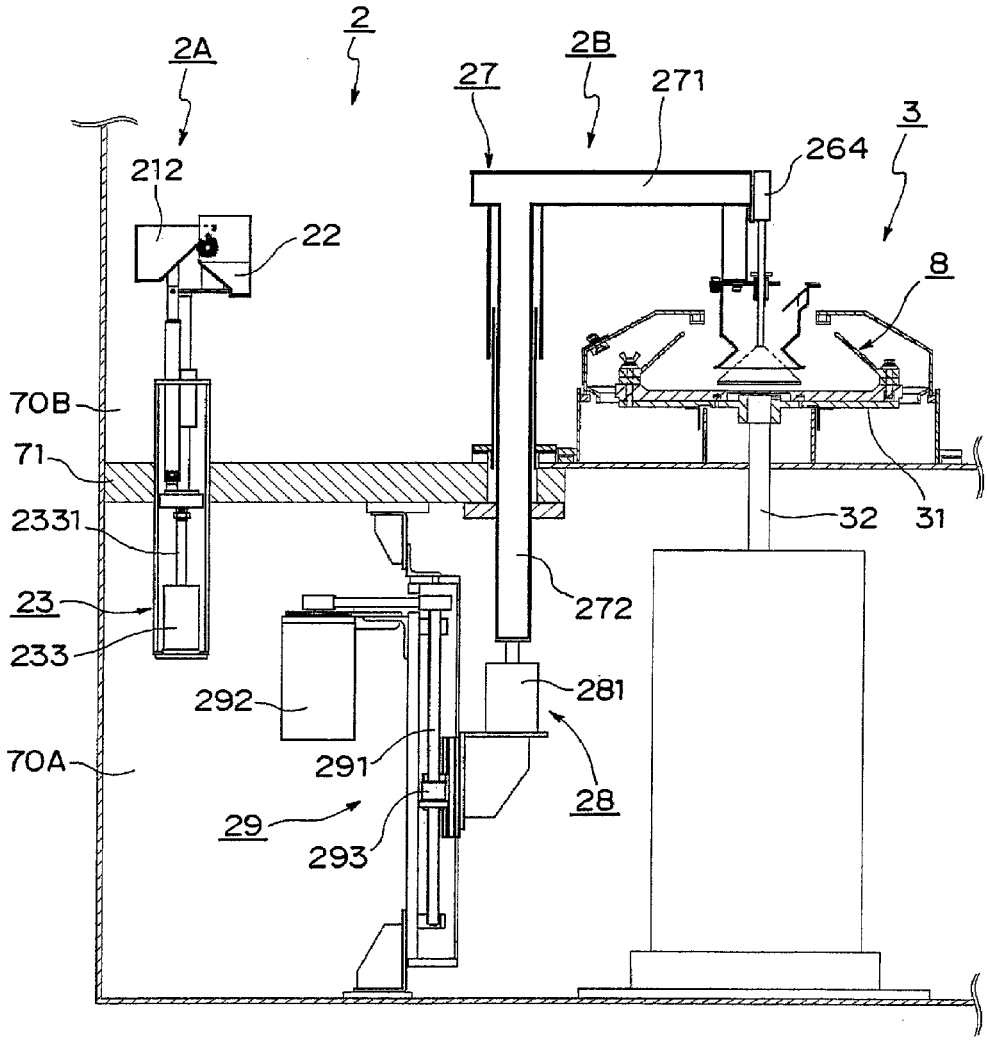
FIG. 7 is a cross-sectional view showing an operating state of the supplying device of the present embodiment.

In FIG. 3, the pot 26 is located at a standby position, and in FIG. 7, the pot 26 is located at an operating position. At the standby position, the inflow port 261 of the pot 26 is located immediately below the hopper 22. At the operating position, the pot 26 is located within the treatment cell 8 disposed at the surface treatment device 3. At the operating position, a vertical distance H from a bottom face 811 of the treatment cell 8 to a lower face of the lid 263 with the pot 26 opened is set so as to be 1 mm to 2 cm.

(3) Surface Treatment Device 3

(3-1) Overall Structure

Figure 8:
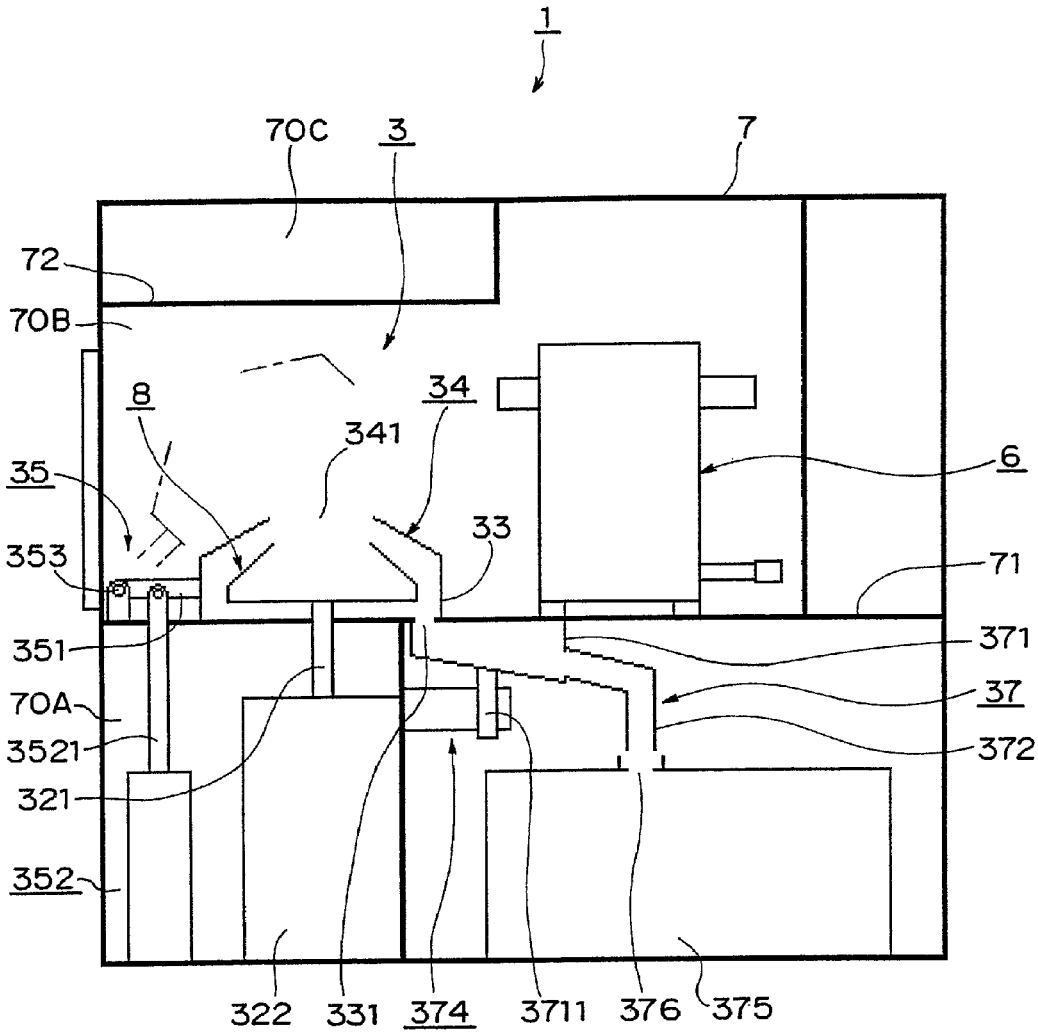
FIG. 8 is a cross-sectional view taken along the VIII-VIII of FIG. 2.

FIG. 8 is a cross-sectional view taken along the VIII-VIII of FIG. 2. As shown in FIGS. 2, 3 and 8, the surface treatment devices 3 each include: a receiving plate 31 on which the treatment cell 8 is placed; a rotation driving means 32 for rotating the receiving plate 31 within a horizontal plane; a receiving tank 33, located below the receiving plate 31, for receiving a surface treatment liquid and a cleaning water; a cover body 34 for covering, from above, the treatment cell 8 placed on the receiving plate 31; an opening/closing means 35 for opening/closing the cover body 34 with respect to the treatment cell 8; a positive electrode supporting means 36 (FIG. 2) for supporting a positive electrode 360 so that the positive electrode 360 is used for a surface treatment; and a drain means 37 communicated with the receiving tank 33.

(3-2) Drain Means 37

As shown in FIG. 8, the drain means 37 is provided so as to be communicated with a discharge port 331 of the receiving tank 33, and is located at a position in the space 70A, which is below the carrying device 6 and below the partition plate 71. The drain means 37 includes: a receiving vessel 371 communicated with the discharge port 331; a flexible hose 372 communicated with the receiving vessel 371 and extending downward; two tanks; and a rotation means 374 for rotating the receiving vessel 371 in a predetermined range within a horizontal plane. One of the tanks 375 serves to collect a surface treatment liquid, and the other tank (not shown) serves to collect a cleaning water. It should be noted that in FIG. 8, only the single tank 375 is shown. The tank 375 has, at its upper face, an inlet 376 with which a tip portion of the hose 372 can be communicated. The other tank has the similar inlet. The rotation means 374 is formed so as to rotate a rotation shaft 3711 of the receiving vessel 371 by a motor. Accordingly, upon rotation of the receiving vessel 371, the tip portion of the hose 372 is horizontally moved between the inlet 376 of the tank 375 and the inlet of the other thank.

(3-3) Positive Electrode Supporting Means 36

Figure 9:
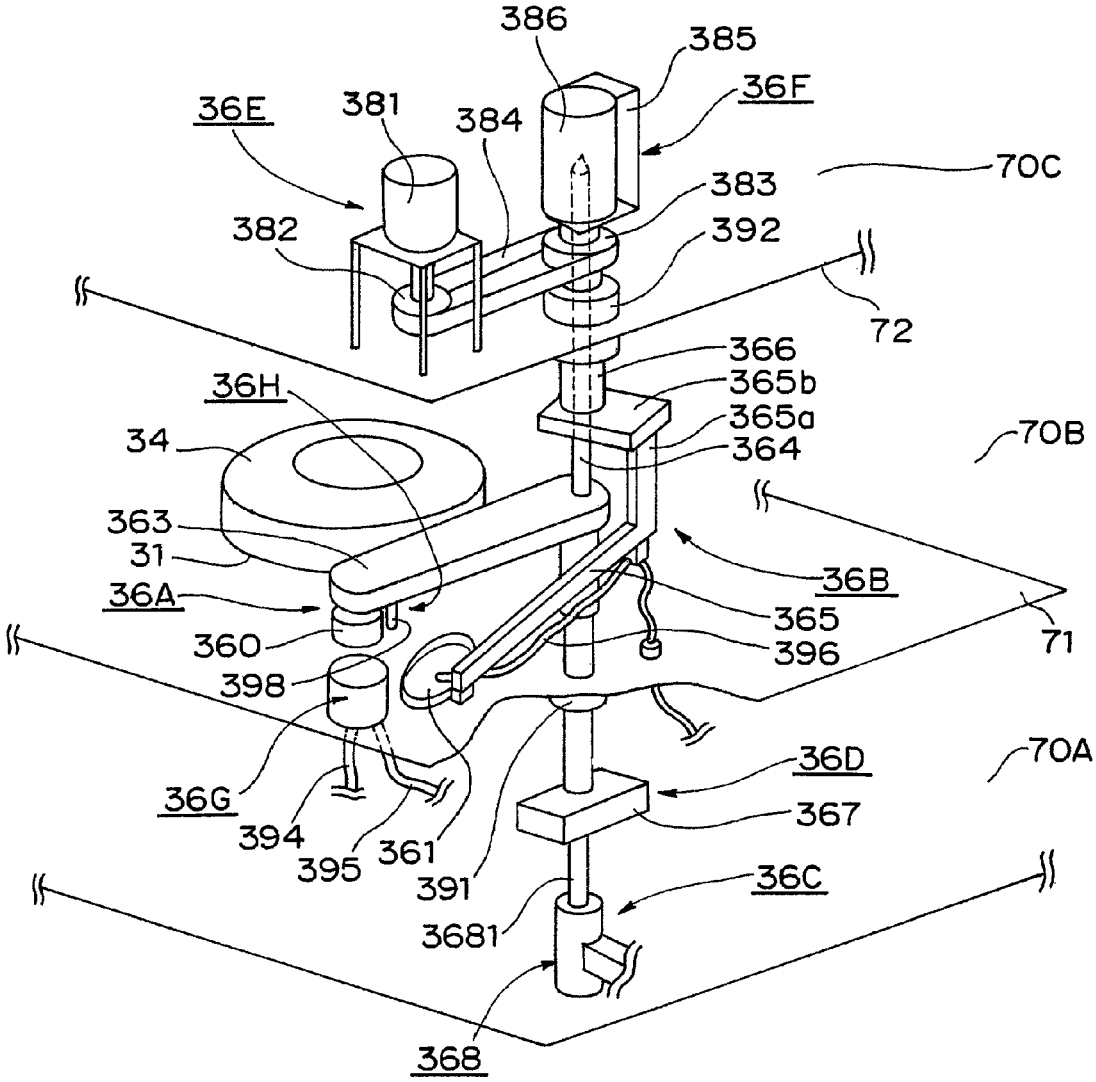
FIG. 9 is a transparent perspective view of a positive electrode supporting means of the present embodiment.

FIG. 9 is a transparent perspective view of the positive electrode supporting means 36. The positive electrode supporting means 36 includes: a positive electrode supporting member 36A for supporting the positive electrode 360; a tray supporting member 36B for supporting a positive electrode tray 361; a raising and lowering means 36C for moving the positive electrode 360 vertically via the positive electrode supporting member 36A; a positive electrode moving means 36D for moving the positive electrode 360 horizontally via the positive electrode supporting member 36A; a tray moving means 36E for moving the positive electrode tray 361 horizontally via the tray supporting member 36B; a connecting means 36F through which the positive electrode supporting member 36A and the tray supporting member 36B are connected to each other; a positive electrode retaining tank 36G for retaining the positive electrode 360; and a supply means 36H for supplying a surface treatment liquid and a cleaning water.

The positive electrode retaining tank 36G is located laterally away from the receiving plate 31, and is disposed onto the partition plate 71. The positive electrode retaining tank 36G contains a surface treatment liquid so that the positive electrode 360 can be immersed therein. The positive electrode retaining tank 36G is connected, at its bottom portion, with two discharge pipes 394 and 395. The discharge pipe 394 is connected to a surface treatment liquid collecting tank 371, and the discharge pipe 395 is connected to a cleaning water collecting tank.

The positive electrode supporting member 36A has: a horizontal arm 363 that holds the positive electrode 360 at its tip portion; and a shaft body 364 extending upward and downward from a base end portion of the horizontal arm 363. The shaft body 364 passes through the partition plate 71 via a bearing 391.

The tray supporting member 36B has: a horizontal arm 365 that supports the positive electrode tray 361 at its tip portion; and a cylindrical body 366 extending upward from a base end portion of the horizontal arm 365 while surrounding the shaft body 364. The cylindrical body 366 passes through the top plate 72 via a bearing 392. It should be noted that the horizontal arm 365 is connected, at its base end, to the cylindrical body 366 via a vertical portion 365*a* and a horizontal portion 365*b*. The positive electrode tray 361 is connected, at its bottom, with a discharge pipe 396, and the discharge pipe 396 is connected to the surface treatment liquid collecting tank 371. A bottom face of the positive electrode tray 361 is inclined so as to be lowered toward the discharge pipe 396.

The positive electrode moving means 36D includes a rotation table 367 fixed at a lower end of the shaft body 364, and is located in the space 70A below the partition plate 71. Accordingly, upon rotation of the rotation table 367, the shaft body 364 is axially rotated, resulting in a horizontal movement of the positive electrode 360 at the tip portion of the horizontal arm 363. In other words, the positive electrode 360 can be horizontally moved between a position above the treatment cell 8 placed onto the receiving plate 31, and a position above the positive electrode retaining tank 36G.

The raising and lowering means 36C includes a vertical cylinder 368 for supporting the rotation table 367 from below, and is located in the space 70A below the partition plate 71. The rotation table 367 is fixed at an upper end of a rod 3681 of the cylinder 368. Accordingly, when the cylinder 368 is operated and the rod 3681 is moved forward/backward, the shaft body 364 and the horizontal arm 363 are vertically moved, resulting in a vertical movement of the positive electrode 360. In other words, the positive electrode 360 can be taken in and out of the positive electrode retaining tank 36G, and can also be taken in and out of the treatment cell 8 placed onto the receiving plate 31.

The tray moving means 36E includes: a motor 381; a first pulley 382 fixed to an output shaft of the motor 381; a second pulley 383 fixed to the cylindrical body 366; and a belt 384 through which both the pulleys 382 and 383 are connected. Accordingly, upon operation of the motor 381, the second pulley 383 and the cylindrical body 366 are rotated via the first pulley 382 and the belt 384, resulting in a horizontal movement of the positive electrode tray 361.

The connecting means 36F includes an air chuck 386 fixed via a bracket 385 to the second pulley 383. The air chuck 386 is located at an upper end portion of the shaft body 364, and is formed so as to be capable of gripping the shaft body 364. Accordingly, upon gripping of the shaft body 364 by the air chuck 386, the rotation of the shaft body 364 is transmitted to the cylindrical body 366, and the shaft body 364 and the cylindrical body 366 are rotated together. As a result, the positive electrode 360 and the positive electrode tray 361 are horizontally moved together. It should be noted that, at this time, the operation of the motor 381 is stopped. Further, the air chuck 386 is set so as to connect the shaft body 364 and the cylindrical body 366 when the positive electrode 360 starts a horizontal movement from above the positive electrode retaining tank 36G or from above the treatment cell 8 by the positive electrode moving means 36D and the positive electrode tray 361 is located below the positive electrode 360 by the tray moving means 36E.

The supply means 36H includes a first supply means for supplying a surface treatment liquid, and a second supply means for supplying a cleaning water. The first supply means includes: a tank (not shown) for storing the surface treatment liquid; and a supply pipe 398 extending from the tank to the tip portion of the horizontal arm 363 via a pump, and facing downward therefrom. The second supply means includes a tank (not shown) for storing the cleaning water; and a supply pipe (not shown) extending from the tank to the tip portion of the horizontal arm 363 via a pump, and facing downward therefrom.

(3-4) Other Features

The rotation driving means 32 is formed so as to rotate a vertical rotation shaft 321 by a motor 322.

The cover body 34 has an opening 341 at its center.

The opening/closing means 35 includes: an arm 351 extending from a lateral portion of the cover body 34; and a vertical cylinder 352 connected to the arm 351. The arm 351 is connected, at its one end, to the cover body 34, and is rotatably fixed, at its other end 353, onto the partition plate 71. A tip of a rod 3521 of the cylinder 352 is rotatably connected somewhere along the arm 351. Accordingly, when the cylinder 352 is operated and the rod 3521 is extended upward, the arm 351 is pivoted upward on the other end 353; as a result, the cover body 34 is opened as indicated by the alternative long and short dashed lines in FIG. 8.

(4) Treatment Cell 8

Figure 10:
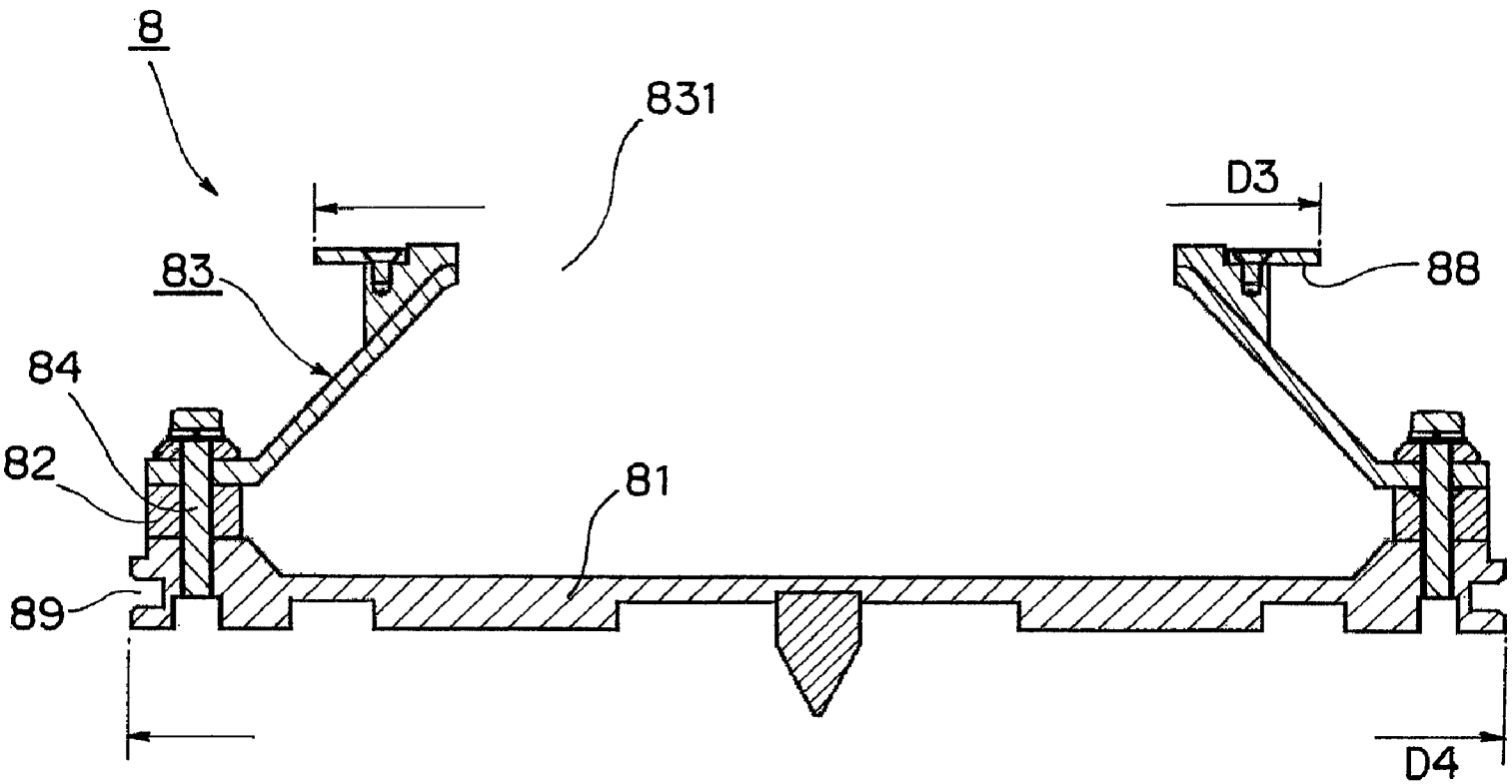
FIG. 10 is a longitudinal cross-sectional view of a treatment cell of the present embodiment.

FIG. 10 is a longitudinal cross-sectional view of the treatment cell 8. The treatment cell 8 includes a non-conductive bottom plate 81, an electrode ring 82, and a cover 83, which are superposed in this order from the bottom and are combined by bolts 84 passing through the electrode ring 82, and has a flow-out means (not shown) for flowing out the surface treatment liquid from the inside of the treatment cell 8 to the outside thereof. The cover 83 is formed into a dome shape, and has an opening 831 at its center.

The electrode ring 82 can be energized through the bolts 84 from the receiving plate 31 of the surface treatment device 3. Further, the surface treatment device 3 is formed so as to energize the surface treatment liquid within the treatment cell 8 from the positive electrode 360 while bringing the workpiece into contact with the electrode ring 82 and circulating the surface treatment liquid from the inside of the treatment cell 8 to the outside thereof through the flow-out means by rotating the treatment cell 8 containing the workpiece, thereby performing a surface treatment on the workpiece.

As the flow-out means, gap channels formed between the bottom plate 81 and the electrode ring 82 are adopted. Sheet members (not shown), made of resin and having the same size, are arranged circumferentially at appropriate intervals between the bottom plate 81 and the electrode ring 82, and the sheet members are sandwiched between the bottom plate 81 and the electrode ring 82, thus forming the gap channels between the adjacent sheet members.

Furthermore, at a peripheral surface of the bottom plate 81, a circumferentially continuous groove 89 is formed. Moreover, at a periphery of an upper edge of the cover 83, a circumferentially continuous and outwardly extending flange 88 is formed. A diameter D3 of the flange 88 of the treatment cell 8 is smaller than a maximum diameter D4 of the treatment cell 8.

(5) Workpiece Collection Device 4

Figure 11:
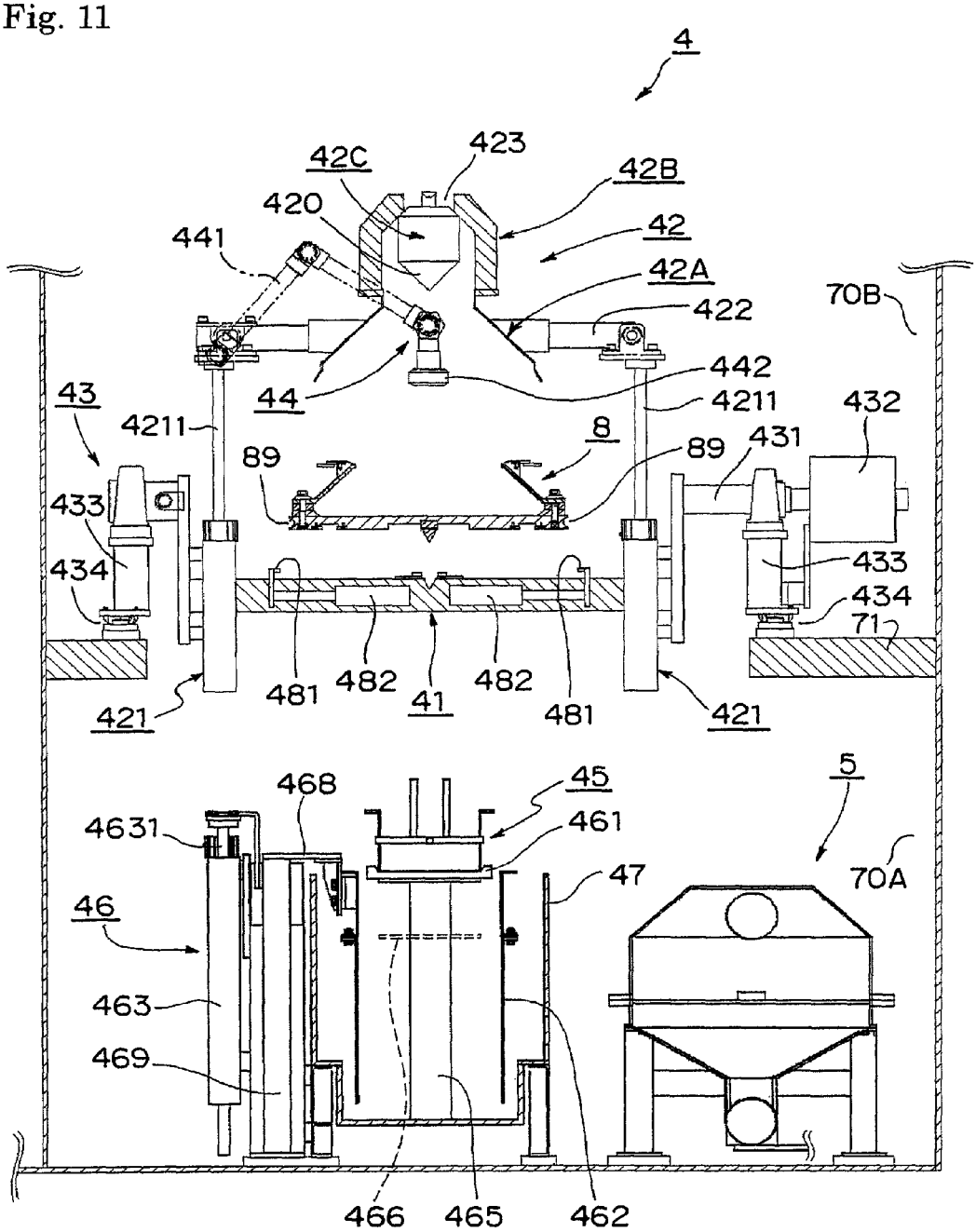
FIG. 11 is a longitudinal cross-sectional view showing operation starting states of a workpiece collection device and a drying device of the present embodiment.
Figure 12:
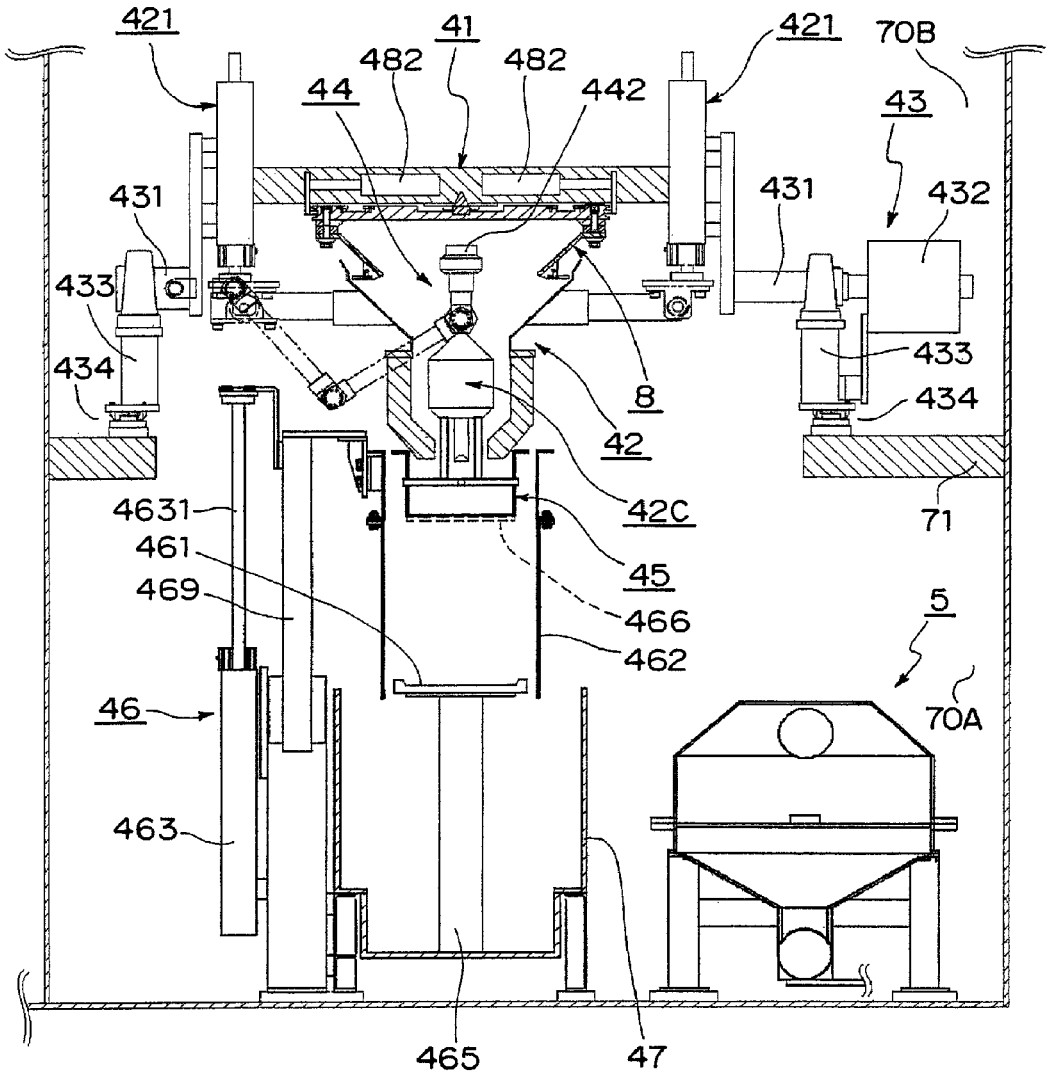
FIG. 12 is a longitudinal cross-sectional view showing operating states of the workpiece collection device and drying device of the present embodiment.

FIG. 11 is a longitudinal cross-sectional view showing the workpiece collection device 4 and the drying device 5. FIG. 11 shows operation starting states of the workpiece collection device 4 and the drying device 5, while FIG. 12 shows operating states of the workpiece collection device 4 and the drying device 5. The workpiece collection device 4 includes: a receiving plate 41 on which the treatment cell 8 is placed; a hopper 42 for covering the treatment cell 8 placed on the receiving plate 41; an inverting means 43 for inverting both of the treatment cell 8 placed on the receiving plate 41, and the hopper 42; a cleaning water supply means 44 for squirting the inside of the inverted treatment cell 8 with a cleaning water; a collection vessel 45 for collecting the workpiece, which has been flowed out of the treatment cell 8 with the cleaning water, by filtering out the workpiece by a filter member; a raising and lowering means 46 for raising the collection vessel 45 so as to close a discharge port 423 of the inverted hopper 42 from below; and a collection tank 47 for receiving the used cleaning water. The receiving plate 41, the hopper 42, the inverting means 43, and the cleaning water supply means 44 are located in the space 70B above the partition plate 71, while the collection vessel 45, the raising and lowering means 46, and the collection tank 47 are located in the space 70A below the partition plate 71.

The receiving plate 41 includes a gripping means 48 for laterally sandwiching and gripping the placed treatment cell 8. The gripping means 48 includes: a pair of gripping protrusive portions (gripping members) 481 to be fitted into the groove 89 of the treatment cell 8 laterally from both sides; and horizontal cylinders 482 for laterally moving the pair of respective gripping protrusive portions 481. Accordingly, when the cylinders 482 are operated and rods 4821 are retracted, the gripping protrusive portions 481 are fitted into the groove 89; as a result, the gripping means 48 grips the treatment cell 8.

The hopper 42 is supported by a pair of vertical cylinders 421 fixed at both lateral sides of the receiving plate 41. An arm 422 is put over tips of rods 4211 of the pair of cylinders 421, and the hopper 42 is supported at the center of the arm 422. In the operation starting state shown in FIG. 11, the hopper 42 is located above the treatment cell 8 placed on the receiving plate 41, a covering portion 42A of the hopper 42 is largely opened downward, and a discharge portion 42B of the hopper 42 is slightly opened upward. The discharge port 423 of the discharge portion 42B is provided with a lid member 42C. The lid member 42C is urged toward the discharge port 423 from inside, and is provided so as to close the discharge port 423 from inside. An inner portion 420 of the lid member 42C has an inwardly tapered conical shape.

The inverting means 43 includes: a horizontal rotation shaft 431 for supporting the receiving plate 41, the hopper 42 and the cylinders 421 in a unified manner; and a motor 432 for rotating the horizontal rotation shaft 431. The horizontal rotation shaft 431 is supported over the partition plate 71 via bearings 433 and rails 434 at both lateral sides. The horizontal rotation shaft 431 is movable in a Y direction of FIG. 2 (back and forth) along the two rails 434.

The cleaning water supply means 44 has a supply pipe 441 extending from a cleaning water supply source (not shown) to the inside of the hopper 42. The supply pipe 441 has a sprinkler 442 at its tip, and the sprinkler 442 is provided so as to eject a cleaning water toward the inside of the treatment cell 8 when the hopper 42 covers the treatment cell 8.

Figure 13:
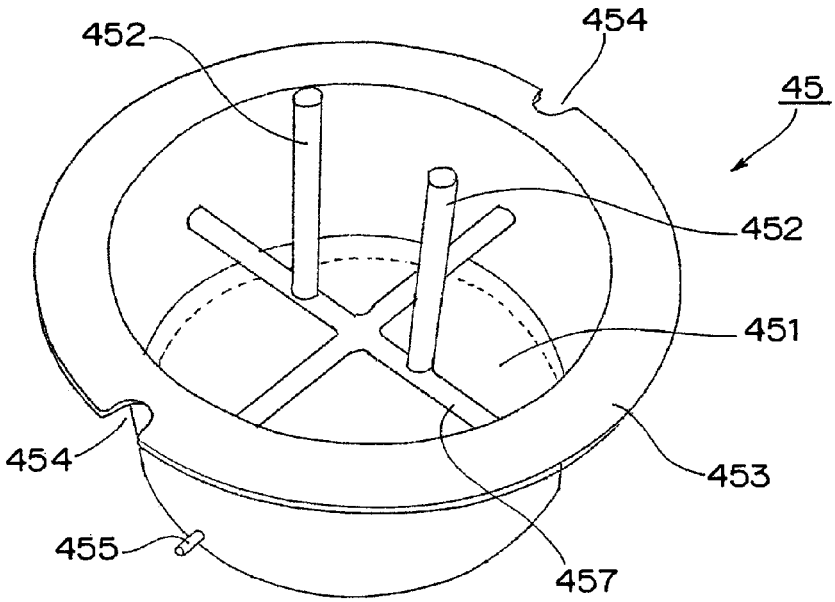
FIG. 13 is a perspective view of a collection vessel of the workpiece collection device of the present embodiment.

The collection vessel 45 is an approximately cylindrical vessel having a bottom 451 as shown in FIG. 13, and the bottom 451 is constituted by the filter member capable of filtering out the workpiece. The filter member consists of a mesh plate provided with a large number of through holes each having a size through which the workpiece and dummy cannot pass, for example. The collection vessel 45 is internally provided with two pins 452 extending upward in parallel from a frame 457 formed in the shape of a cross. The pins 452 are protruded slightly above an upper edge of the collection vessel 45. The collection vessel 45 has, at its upper edge, a circumferentially continuous and outwardly extending flange 453. The flange 453 has alignment cut-outs 454 at its opposite positions. The collection vessel 45 has, at peripheral opposite positions of its bottom, alignment lateral pins 455. The cut-outs 454 and the lateral pins 455 are located at positions overlapping with each other in plan view.

Figure 14:
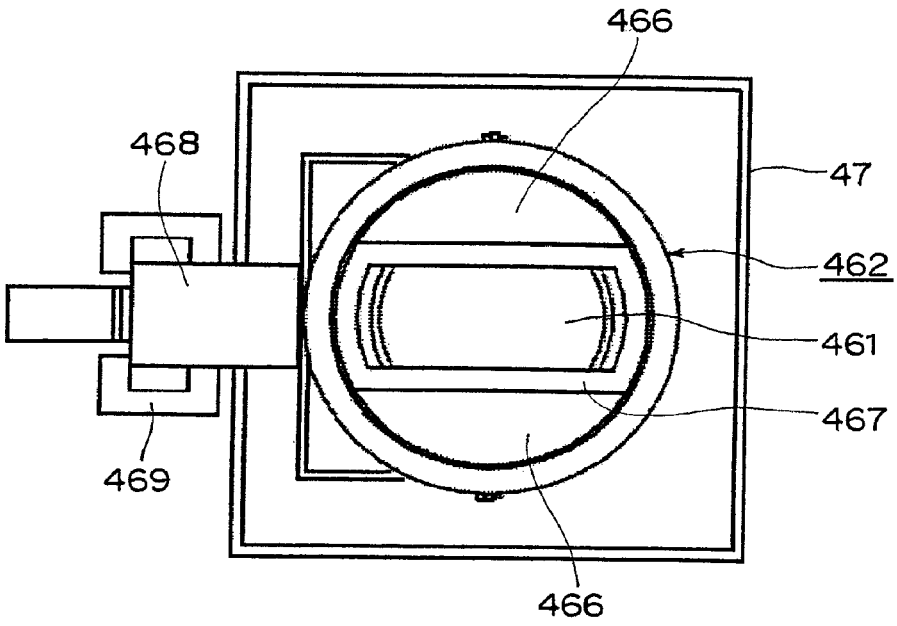
FIG. 14 is a plan view of a cylindrical body of the workpiece collection device of the present embodiment.

The raising and lowering means 46 includes: a receiving plate 461 on which the collection vessel 45 is placed; a cylindrical body 462 provided so as to surround the collection vessel 45 placed on the receiving plate 461; and a vertical cylinder 463 for vertically moving the cylindrical body 462. The receiving plate 461 is fixed at an upper end of a support post 465 extending vertically within the cylindrical body 462. FIG. 14 is a plan view of the cylindrical body 462. The cylindrical body 462 has, at both lateral sides of the inside, a pair of receiving plates (receiving portions) 466. A gap 467 between the pair of receiving plates 466 has a size through which the receiving plate 461 and the support post 465 can pass but the collection vessel 45 cannot pass. In other words, the receiving plate 461 has an elongated shape in plan view. The cylindrical body 462 is supported by an arm 468 extending laterally from a tip of a rod 4631 of the cylinder 463. The arm 468 is provided so as to slide vertically along a guide 469. Accordingly, when the cylinder 463 is operated and the rod 4631 is extended, the cylindrical body 462 is raised, and the receiving plates 466 are raised while they abut against a lower face of the collection vessel 45; as a result, the cylindrical body 462 lifts the collection vessel 45.

The collection tank 47 is provided so as to cover, from below, the cylindrical body 462, which is in an operation starting state.

Figure 15:
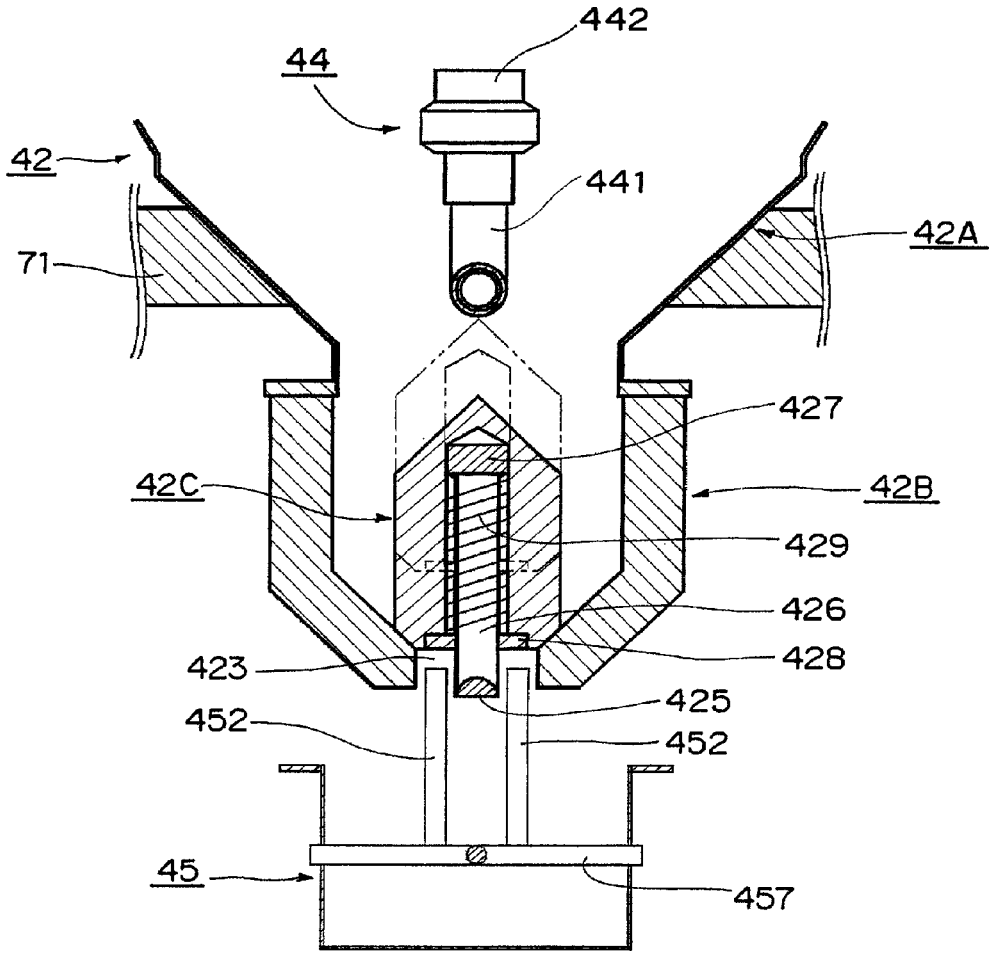
FIG. 15 is an enlarged partial cross-sectional view showing a state of the workpiece collection device of the present embodiment in the midst of an operation.

FIG. 15 is an enlarged longitudinal cross-sectional view showing a state in which the collection vessel 45 is coming close to the discharge portion 42B of the inverted hopper 42 from below. The discharge portion 42B of the hopper 42 is provided with a frame 425 that traverses the discharge port 423, and a guide rod 426 extends upward from the center of the frame 425. The lid member 42C is provided so as to cover, from above, the guide rod 426. Between a tip portion 427 of the guide rod 426 and an outer end portion 428 of the lid member 42C, there is provided a spring 429 extended along the guide rod 426. The spring 429 is provided so as to urge the lid member 42C toward the discharge port 423. On the other hand, the two pins 452 of the collection vessel 45 are provided so as to avoid the frame 425 and to be insertable into the discharge port 423. Accordingly, upon raising of the collection vessel 45, the two pins 452 abut against the lid member 42C from below, and push up the lid member 42C along the guide rod 426 against an urging force of the spring 429; as a result, the discharge port 423 is opened.

(6) Drying Device 5

Figure 16:
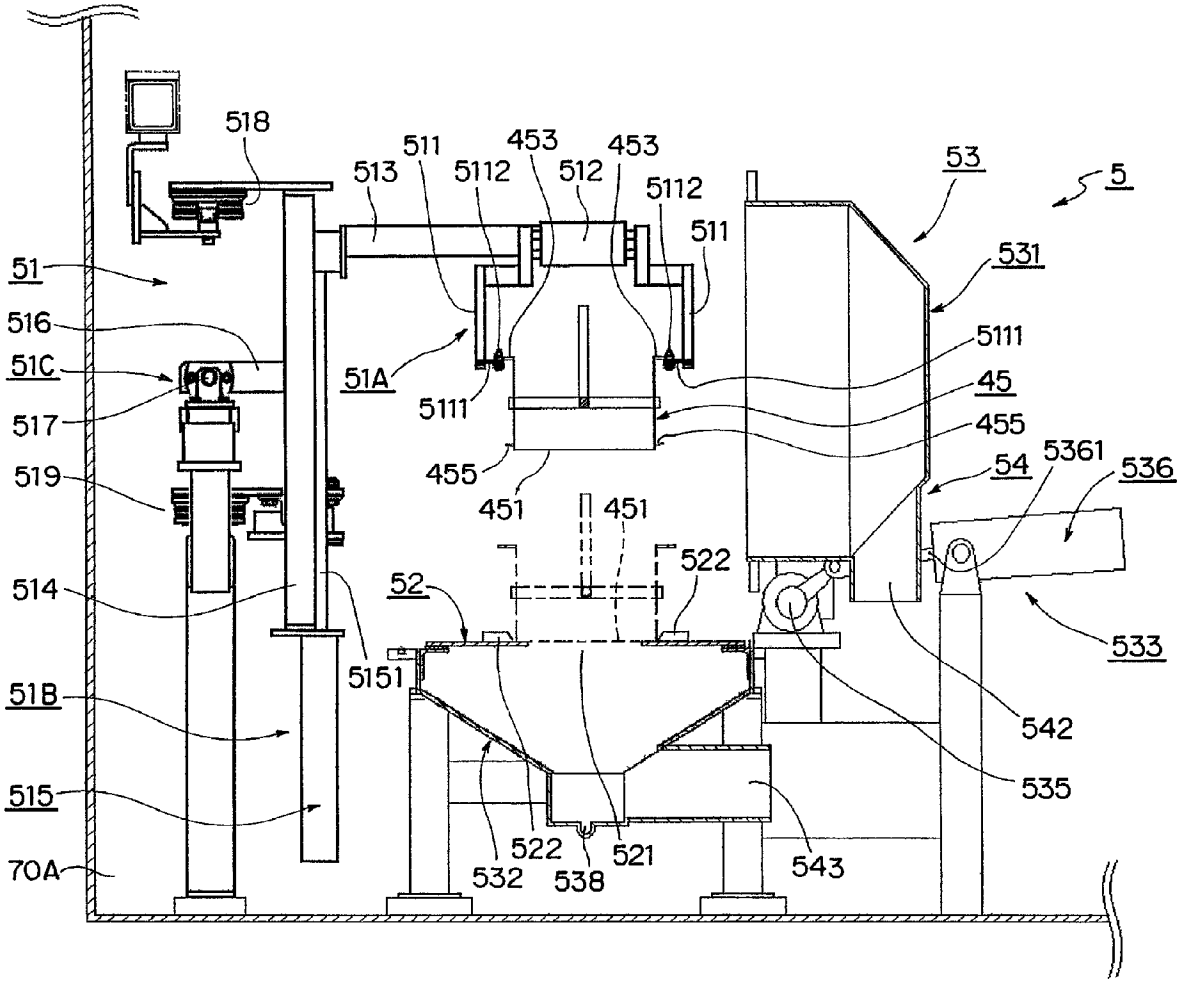
FIG. 16 is a longitudinal cross-sectional view viewed from the arrow XVI of FIG. 1, and is a diagram showing an operation starting state of the drying device.
Figure 17:
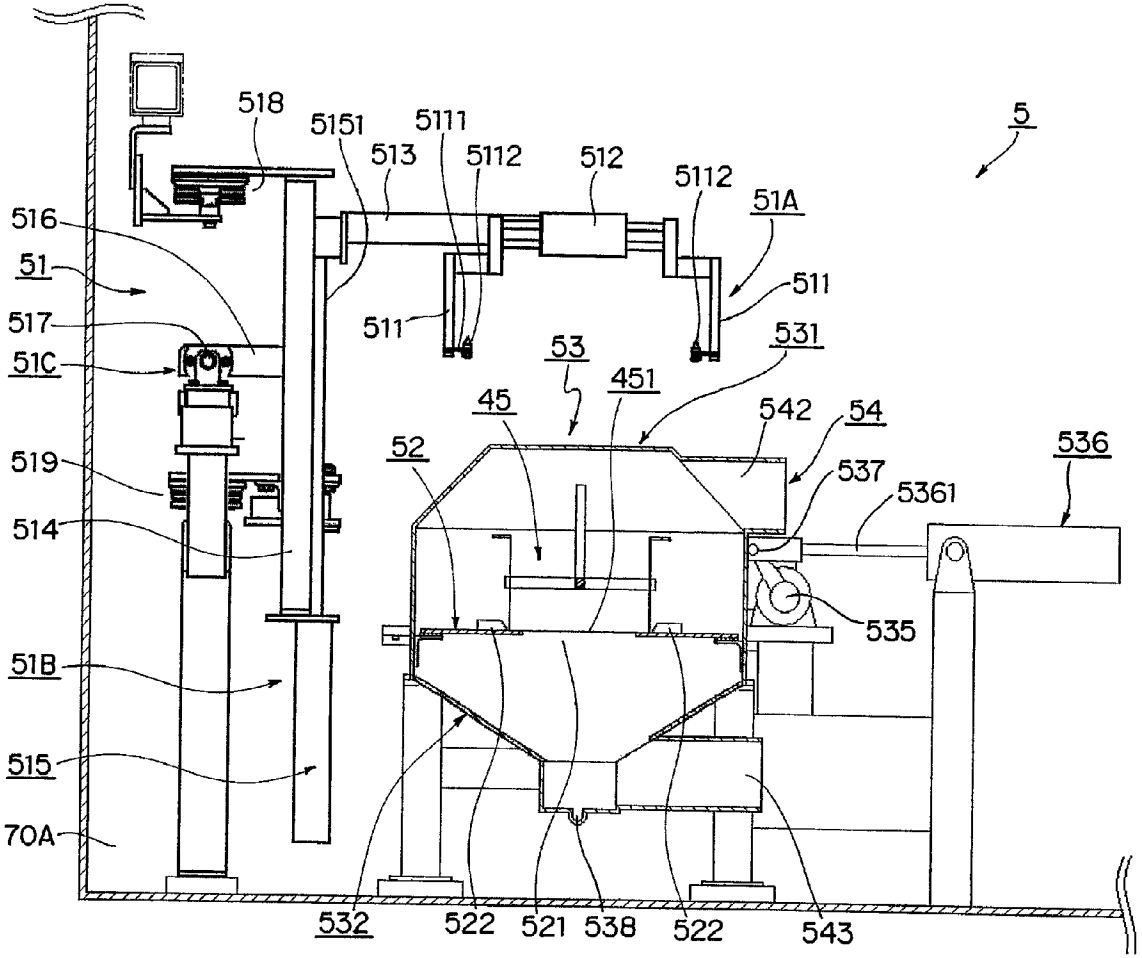
FIG. 17 is a diagram showing an operating state of the drying device shown in FIG. 16.

FIG. 16 is a longitudinal cross-sectional view viewed from the arrow XVI of FIG. 1. FIG. 16 shows an operation starting state of the drying device 5, while FIG. 17 shows an operating state of the drying device 5. The drying device 5 includes: a transportation means 51 for transporting the collection vessel 45 from the workpiece collection device 4; a receiving plate 52 on which the transported collection vessel 45 is placed; a hood 53 for hermetically closing, from above and below, the collection vessel 45 placed on the receiving plate 52; and an air supply and exhaust means 54 for supplying air to and exhausting air from the inside of the hood 53.

The transportation means 51 includes: a gripping means 51A for gripping the collection vessel 45; a raising and lowering means 51B for vertically moving the gripping means 51A; and a moving means 51C for moving the raising and lowering means 51B in an X direction of FIG. 2 (right and left).

The gripping means 51A includes: a pair of gripping arms 511; and a horizontal cylinder 512 for driving the pair of gripping arms 511. The pair of gripping arms 511 each have an inwardly extending gripping plate 5111 at its tip portion. The gripping means 51A is formed so as to grip the collection vessel 45 by placing the flange 453 of the collection vessel 45 onto the gripping plates 5111. The gripping plates 5111 have upwardly extending pins 5112 fitted into the cut-outs 454 of the flange 453. The cylinder 512 drives the pair of gripping arms 511 so as to increase/decrease an opposing interval between the pair of gripping arms 511.

The raising and lowering means 51B includes: a horizontal arm 513 for supporting the gripping means 51A at its tip; a vertical rail 514 for slidably supporting the horizontal arm 513; and a vertical cylinder 515 for moving the horizontal arm 513 vertically along the vertical rail 514. A base end of the horizontal arm 513 is fixed at an upper end of a rod 5151 of the cylinder 515.

The moving means 51C includes: a horizontal arm 516 for supporting the vertical rail 514; and a horizontal cylinder 517 for moving the horizontal arm 516 in the X direction. The vertical arm 514 is provided so as to be movable in the X direction along an upper rail 518 and a lower rail 519.

The receiving plate 52 has a through hole 521 at its portion toward which the bottom 451 of the placed collection vessel 45 faces. The through hole 521 is provided, at opposing positions of its outer edge, with receiving portions 522 to which the lateral pins 455 of the collection vessel 45 are fitted.

The hood 53 includes: an upper hood portion 531 for securing a space above the receiving plate 52 by covering the collection vessel 45; a lower hood portion 532 for securing a space below the receiving plate 52; and an opening/closing means 533 for opening/closing the upper hood portion 531. The opening/closing means 533 includes: a horizontal rotation shaft 535 fixed to the upper hood portion 531; and a cylinder 536 for rotatably driving the horizontal rotation shaft 535. Upon rotation of the horizontal rotation shaft 535, the upper hood portion 531 is rotated around the horizontal rotation shaft 535, i.e., the upper hood portion 531 is opened/closed. A tip of a rod 5361 of the cylinder 536 is connected to the horizontal rotation shaft 535 via a link 537; thus, the cylinder 536 rotates the horizontal rotation shaft 535 by advancing and retracting operations of the rod 5361. The lower hood portion 532 is provided, at its lowermost portion, with an exhaust port 538.

The air supply and exhaust means 54 includes: a blower (not shown) for delivering air, preferably hot air; a supply pipe 542 through which air from the blower is supplied to the inside of the upper hood portion 531; and an exhaust pipe 543 through which air is exhausted from the inside of the lower hood portion 532.

(7) Carrying Device 6

Figure 18:
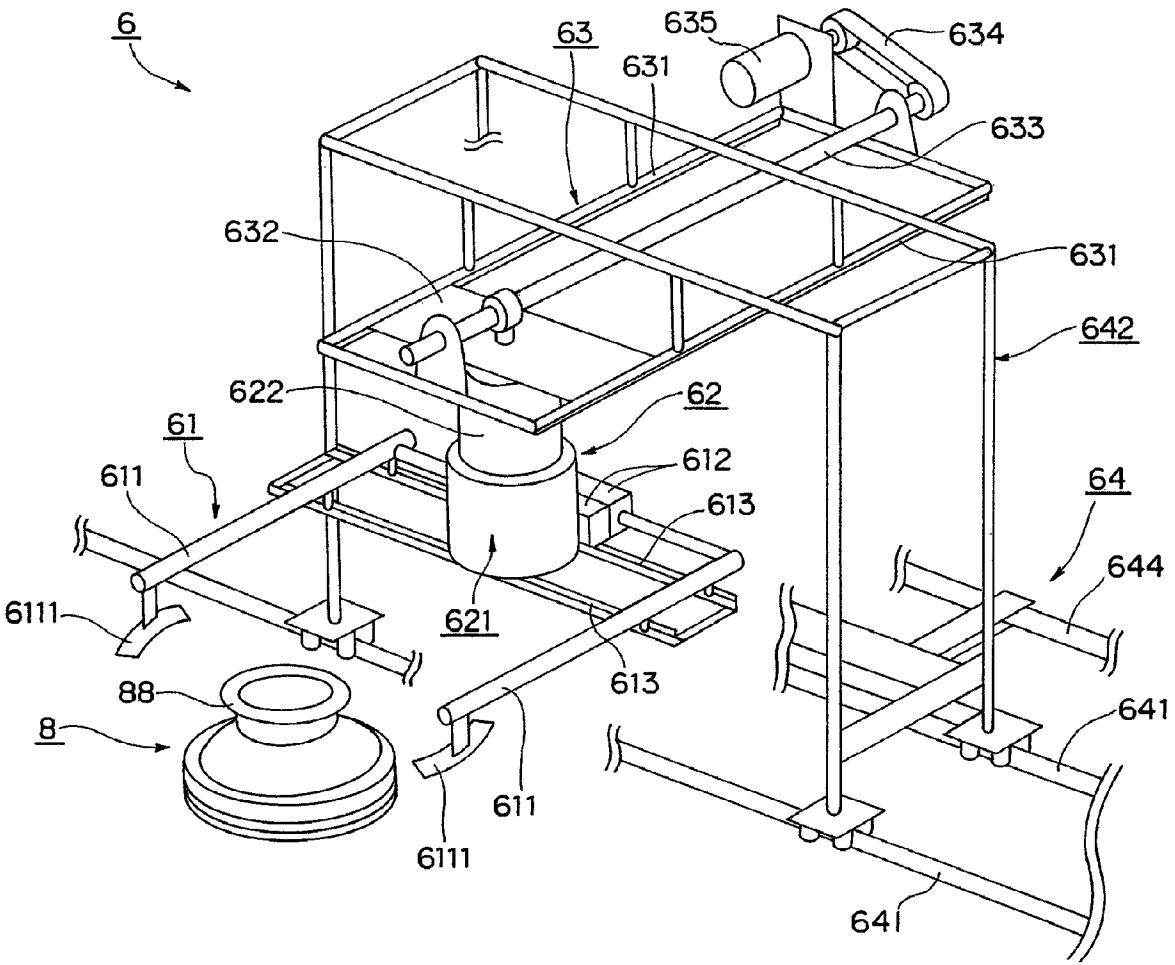
FIG. 18 is an overall perspective view of a carrying device of the present embodiment.

FIG. 18 is an overall perspective view of the carrying device 6. The carrying device 6 includes: a gripping means 61 for gripping the treatment cell 8; a raising and lowering means 62 for vertically moving the gripping means 61; a back-and-forth moving means 63 for moving the entire raising and lowering means 62 back and forth; and a lateral moving means 64 for laterally moving the entire raising and lowering means 62 and the entire back-and-forth moving means 63.

The gripping means 61 includes: a pair of gripping arms 611; and horizontal cylinders 612 for driving the pair of gripping arms 611. Each of the pair of gripping arms 611 has an inwardly extending gripping plate 6111 at its tip portion. The gripping means 61 is formed so as to grip the treatment cell 8 by placing the flange 88 of the treatment cell 8 onto the gripping plates 6111. The cylinders 612 drive the pair of gripping arms 611 so as to increase/decrease an opposing interval between the pair of gripping arms 611. The pair of gripping arms 611 is provided so as to be movable along horizontal rails 613 fixed to the cylinders 612 and extending in the X direction.

The raising and lowering means 62 includes a vertical cylinder 621 for supporting the gripping means 61. At a lower end of the cylinder 621, the cylinders 612 of the gripping means 61 are fixed.

The back-and-forth moving means 63 includes: two horizontal rails 631 extending in the Y direction; a plate member 632 movable along the horizontal rails 631; a ball screw 633 connected at its one end to the plate member 632 and extending in the Y direction; and a motor 635, which is connected to the other end of the ball screw 633 via a belt 634, for rotatably driving the ball screw 633. At a lower face of the plate member 632, an upper end of a rod 622 of the cylinder 621 of the raising and lowering means 62 is fixed. Accordingly, the back-and-forth moving means 63 supports the raising and lowering means 62 and the gripping means 61.

The lateral moving means 64 includes: two horizontal rails 641 extending in the X direction; a frame body 642 movable along the horizontal rails 641; and a motor (not shown) for moving the frame body 642 along the horizontal rails 641. The motor is provided so as to rotate an endless annular belt 644, thereby moving the frame body 642, which is connected to the belt 644, along the horizontal rails 641. The two horizontal rails 631 of the back-and-forth moving means 63 are fixed to the frame body 642. Accordingly, the lateral moving means 64 supports the back-and-forth moving means 63, the raising and lowering means 62 and the gripping means 61.

(B) Next, operations and effects of the surface treatment apparatus 1 with the above-described structure will be described.

(a) Immediately prior to an operation, the empty first treatment cell 8 is set in the first surface treatment device 3, and the empty second treatment cell 8 is set in the workpiece collection device 4. Further, the gripping means 61 of the carrying device 6 is located in the vicinity of the first surface treatment device 3.

(b) An operator introduces a dummy into the first shooter 211 of the supply device 2, introduces a workpiece into the second shooter 212, and then presses an operation start button.

(c) First, the supply device 2 (FIGS. 2 to 7) is operated.

Actually, in the supply device 2 prior to the start of the operation, as shown in FIG. 3, the rod 2331 of the cylinder 233 is in a most retracted state, an outlet 224 of the hopper 22 is inserted into the inflow port 261 of the pot 26, and the lid 263 of the pot 26 is closed.

(c-1) Upon start of the operation, the first raising and lowering means 241 is operated, the rod 2411 is extended, and the first shooter 211 is rotated around the horizontal shaft 213; as a result, the dummy within the first shooter 211 is guided by the hopper 22, and is introduced into the pot 26.

At this time, since the outlet 224 of the hopper 22 is inserted into the inflow port 261 of the pot 26, the scattering of the dummy can be prevented.

(c-2) Next, the cylinder 233 is operated, the rod 2331 is extended, and the hopper 22 is moved away from the pot 26 and is raised. Then, the rotation table 281 is operated, and the vertical pole 272 is axially rotated by 90 degrees together with the horizontal arm 271. Subsequently, the motor 292 is operated, and the rotation table 281 is raised; as a result, the pot 26 is located at a position above the treatment cell 8 set in the surface treatment device 3. Next, the rotation table 281 is operated, and the vertical pole 272 is further axially rotated by 90 degrees together with the horizontal arm 271; as a result, the pot 26 is located above the treatment cell 8. Then, the motor 292 is operated, and the rotation table 281 is lowered; as a result, the discharge portion 262 of the pot 26 is located within the first treatment cell 8. Subsequently, the cylinder 264 is operated, and the lid 263 is lowered; as a result, the discharge portion 262 is opened. Thus, the dummy within the pot 26 slides down on the outer face 2631 of the lid 263, and is discharged from the discharge portion 262. It should be noted that the vertical distance H between the lower face of the lowered lid 263 and the bottom face 811 of the treatment cell 8 is 1 mm to 2 cm. On the other hand, at this time, the treatment cell 8 is gently rotated in the surface treatment device 3.

As described above, the dummy, which has been introduced into the first shooter 211 by the operator, is automatically introduced into the treatment cell 8, and therefore, the operation efficiency can be improved. Furthermore, since the dummy within the pot 26 slides down on the conical outer face 2631 of the lid 263, and is discharged into the treatment cell 8, the dummy is scattered over the bottom face 811 of the treatment cell 8 in a wide range. Moreover, since the treatment cell 8 is rotated at this time, the dummy is scattered in a wider range. Hence, the dummy, and the subsequently introduced workpiece can be efficiently mingled. Besides, since the distance H is 1 mm to 2 cm, an impact applied to the dummy and the bottom face 811 of the treatment cell 8 can be alleviated, and the breakage of the dummy and the bottom face 811 can be accordingly prevented. In addition, the discharge portion 262 is closed by bringing the outer face 2631 of the lid 263 into face-to-face contact with the inner face 2622 of the discharge portion 262, and therefore, the leakage of the dummy from the pot 26 before introduction can be prevented.

(c-3) Next, when the introduction of the dummy into the treatment cell 8 has been finished, the cylinder 264 is operated, and the lid 263 is raised; as a result, the discharge portion 262 is closed. Then, the motor 292 is operated, and the rotation table 281 is raised; as a result, the pot 26 is upwardly moved out of the treatment cell 8. Subsequently, the rotation table 281 is operated, and the vertical pole 272 is axially rotated by 90 degrees together with the horizontal arm 271; as a result, the pot 26 is laterally moved away from the treatment cell 8. Next, the motor 292 is operated, and the rotation table 281 is lowered; as a result, the pot 26 is lowered. Then, the rotation table 281 is operated, the vertical pole 272 is further axially rotated by 90 degrees together with the horizontal arm 271, and the pot 26 is located below the hopper 22. Subsequently, the cylinder 233 is operated, the rod 2331 is retracted, and the outlet 224 of the hopper 22 is inserted into the inflow port 261 of the pot 26.

(c-4) Next, the second raising and lowering means 242 is operated, the rod 2412 is extended, and the second shooter 212 is rotated around the horizontal shaft 213; as a result, the workpiece within the second shooter 212 is guided by the hopper 22, and is discharged into the pot 26. Thereafter, operations similar to those described in the foregoing section (c-2) are performed, and the workpiece is introduced into the treatment cell 8.

As described above, the workpiece, which has been introduced into the second shooter 212 by the operator, is automatically introduced into the treatment cell 8, and therefore, the operation efficiency can be improved. Furthermore, since the workpiece within the pot 26 slides down on the conical outer face 2631 of the lid 263, and is discharged into the treatment cell 8, the workpiece is scattered over the bottom face 811 of the treatment cell 8 in a wide range. Moreover, since the treatment cell 8 is rotated at this time, the workpiece is scattered in a wider range. Furthermore, the dummy has already been scattered within the treatment cell 8, the workpiece and the dummy can be efficiently mingled. Besides, since the distance H is 1 mm to 2 cm, an impact applied to the workpiece and the bottom face 811 of the treatment cell 8 can be alleviated, and the breakage of the workpiece and the bottom face 811 can be accordingly prevented. In addition, the discharge portion 262 is closed by bringing the outer face 2631 of the lid 263 into face-to-face contact with the inner face 2622 of the discharge portion 262, and therefore, the leakage of the workpiece from the pot 26 before introduction can be prevented.

(c-5) When the introduction of the workpiece into the treatment cell 8 has been finished, the supply device 2 performs operations similar to those described in the foregoing section (c-3), and then returns to the state shown in FIG. 3.

As described above, in the supply device 2, the dummy and the workpiece are separately introduced into the treatment cell 8, and therefore, the workpiece can be prevented from being crushed by the dummy. Further, the vertical pole 272 is surrounded by the inner sleeve 273 and the outer sleeve 274, and in addition, the movement means 28 and the raising and lowering means 29 are located in the space 70A below the partition plate 71; therefore, even if the surface treatment liquid is scattered, the contamination of these components by the surface treatment liquid can be prevented.

(d) Next, the first surface treatment device 3 (FIGS. 8 and 9) is operated.

Actually, in the surface treatment device 3 prior to the start of the operation, the cover body 34 is closed, the positive electrode 360 is contained in the positive electrode retaining tank 36G, the positive electrode tray 361 is located laterally away from the positive electrode 360, and the air chuck 386 is in a non-gripping state.

(d-1) Upon start of the operation, the cylinder 368 is operated, and the rotation table 367, the shaft body 364 and the horizontal arm 363 are raised in a unified manner; as a result, the positive electrode 360 is moved out of the positive electrode retaining tank 36G, and is located above the positive electrode retaining tank 36G. Next, the motor 381 is operated, and the cylindrical body 366 is rotated via the first pulley 382, the belt 384 and the second pulley 383; as a result, the positive electrode tray 361 is moved, and is located immediately below the positive electrode 360. Then, the air chuck 386 grips the shaft body 364 and the rotation table 367 is operated; thus, the shaft body 364 and the cylindrical body 366 are rotated in a unified manner, i.e., the horizontal arm 363 and the horizontal arm 365 are rotated in a unified manner. As a result, the positive electrode tray 361 and the positive electrode 360 are horizontally moved in a unified manner with the positive electrode tray 361 located immediately below the positive electrode 360, and the positive electrode tray 361 is located above the treatment cell 8 together with the positive electrode 360. Then, the air chuck 386 enters the non-gripping state, the motor 381 is operated, and the cylindrical body 366 is rotated via the first pulley 382, the belt 384 and the second pulley 383; as a result, the positive electrode tray 361 is moved from a position immediately below the positive electrode 360 to a position laterally away therefrom. Subsequently, the cylinder 368 is operated, and the rotation table 367, the shaft body 364 and the horizontal arm 363 are lowered in a unified manner; as a result, the positive electrode 360 is inserted into the treatment cell 8.

(d-2) Next, a voltage is applied via the positive electrode 360, and a surface treatment is performed on the workpiece while the surface treatment liquid is supplied to the inside of the treatment cell 8 by the first supply means. At this time, the surface treatment liquid flowed out of the treatment cell 8 is discharged to the tank 375 via the receiving tank 33, the receiving vessel 371 and the hose 372.

(d-3) When the surface treatment has been finished, the cleaning water is supplied to the inside of the treatment cell 8 by the second supply means, thereby performing a water washing process on the workpiece. At this time, the cleaning water flowed out of the treatment cell 8 is discharged to the other tank via the receiving tank 33, the receiving vessel 371 and the hose 372.

(d-4) When the water washing process has been finished, the cylinder 368 is operated, the rotation table 367, the shaft body 364 and the horizontal arm 363 are raised in a unified manner; as a result, the positive electrode 360 is moved out of the treatment cell 8, and is located above the treatment cell 8. Next, the motor 381 is operated, and the cylindrical body 366 is rotated via the first pulley 382, the belt 384 and the second pulley 383; as a result, the positive electrode tray 361 is moved, and is located immediately below the positive electrode 360. Then, the air chuck 386 grips the shaft body 364 and the rotation table 367 is operated; thus, the shaft body 364 and the cylindrical body 366 are rotated in a unified manner, i.e., the horizontal arm 363 and the horizontal arm 365 are rotated in a unified manner. As a result, the positive electrode tray 361 and the positive electrode 360 are horizontally moved in a unified manner with the positive electrode tray 361 located immediately below the positive electrode 360, and the positive electrode tray 361 is located above the positive electrode retaining tank 36G together with the positive electrode 360. Then, the air chuck 386 enters the non-gripping state, the motor 381 is operated, and the cylindrical body 366 is rotated via the first pulley 382, the belt 384 and the second pulley 383; as a result, the positive electrode tray 361 is moved from a position immediately below the positive electrode 360 to a position laterally away therefrom. Subsequently, the cylinder 368 is operated, and the rotation table 367, the shaft body 364 and the horizontal arm 363 are lowered in a unified manner; as a result, the positive electrode 360 is contained in the positive electrode retaining tank 36G.

Thus, the surface treatment and water washing process are performed on the workpiece within the treatment cell 8. Since the positive electrode 360 is contained in the positive electrode retaining tank 36G and immersed in the surface treatment liquid during the non-operation period of the surface treatment device 3, the degradation of the positive electrode 360 can be prevented, and furthermore, the crystallization of the surface treatment liquid adhered to the positive electrode 360 can be prevented. Moreover, when the positive electrode 360 is moved between the positive electrode retaining tank 36G and the treatment cell 8, the positive electrode tray 361 is located immediately below the positive electrode 360, and therefore, the surface treatment liquid dripping down from the positive electrode 360 can be received by the positive electrode tray 361. Accordingly, the contamination of the periphery of the surface treatment device 3 by the surface treatment liquid can be prevented. In addition, since the bottom face of the positive electrode tray 361 is inclined so as to be lowered toward the discharge pipe 396, the surface treatment liquid received by the positive electrode tray 361 can be discharged with certainty, and furthermore, the cleaning of the positive electrode tray 361 can be easily carried out.

(d-5) When the surface treatment and the water washing process have been finished, the operation of the rotation driving means 32 is stopped, and the rotation of the treatment cell 8 is stopped. Then, the opening/closing means 35 is operated, and the cover body 34 is opened.

(e) Next, the carrying device 6 (FIG. 18) is operated.

Actually, in the carrying device 6 prior to the start of the operation, as shown in FIG. 18, the cylinders 612 maximize the opposing interval between the pair of gripping arms 611, and the plate member 632 is located away from the surface treatment device 3 toward a Y2 direction of FIG. 2 (backward). \

(e-1) First, the motor 635 is operated, and the ball screw 633 is rotated; as a result, the plate member 632 is moved toward the surface treatment device 3 along the rails 631, and is located in the vicinity of the surface treatment device 3.

(e-2) Next, the cylinder 621 is operated, and the gripping means 61 is lowered; as a result, the gripping plates 6111 are each located at a position below the flange 88 of the treatment cell 8. Then, the cylinders 612 are operated, and the opposing interval between the pair of the gripping arms 611 is reduced; as a result, the gripping plates 6111 are located immediately below the flange 88 of the treatment cell 8. Subsequently, the cylinder 621 is operated, and the gripping plates 6111 are raised; as a result, the gripping plates 6111 abut against a lower face of the flange 88 of the treatment cell 8 to lift the treatment cell 8.

(e-3) Next, the motor 635 is operated, and the ball screw 633 is rotated; as a result, the plate member 632 is moved in a direction away from the surface treatment device 3 (i.e., in the Y2 direction of FIG. 2) along the rails 631, and is located at the rear of the surface treatment device 3.

(e-4) Next, the motor (not shown) is operated, and the belt 644 is moved; as a result, the frame body 642 is moved, and is located at the rear of the second surface treatment device 3.

(e-5) Next, the motor 635 is operated, and the ball screw 633 is rotated; as a result, the plate member 632 is moved toward the second surface treatment device 3 in a Y1 direction of FIG. 2 (forward) along the rails 631, and is located in the vicinity of the surface treatment device 3.

(e-6) Next, the cylinder 621 is operated, and the gripping means 61 lowers while gripping the treatment cell 8; as a result, the treatment cell 8 is placed on the receiving plate 31 of the surface treatment device 3, and the gripping plates 6111 are further lowered and located below the flange 88 of the treatment cell 8. Then, the cylinders 612 are operated, and the opposing interval between the pair of the gripping arms 611 is increased; as a result, the gripping plates 6111 are each located laterally away from a position immediately below the flange 88 of the treatment cell 8. Subsequently, the cylinder 621 is operated, and the gripping plates 6111 are raised.

(e-7) Next, the motor 635 is operated, and the ball screw 633 is rotated; as a result, the plate member 632 is moved in a direction away from the surface treatment device 3 along the rails 631, and is located at the rear of the surface treatment device 3.

Thus, the treatment cell 8, which has been set in the first surface treatment device 3, is carried to and set in the second surface treatment device 3 by the carrying device 6. In the carrying device 6, since the treatment cell 8 is carried while being moved to the rear, a space in the vertical direction in the surface treatment apparatus 1 can be reduced, and the size reduction of the apparatus can be accordingly realized. Furthermore, since the diameter D3 of the flange 88 of the treatment cell 8 is smaller than the maximum diameter D4 of the treatment cell 8, the size of the gripping means 61 in the X direction can be reduced, and the size reduction of the carrying device 6 can be accordingly realized.

(f) Next, the second surface treatment device 3 is operated. This operation is similar to that of the first surface treatment device 3. It is to be noted that in the second surface treatment device 3, a surface treatment liquid, which is different from the surface treatment liquid used in the first surface treatment device 3, is used.

(g) Next, the carrying device 6 is operated, and the treatment cell 8 is carried from the second surface treatment device 3 to the workpiece collection device 4. This operation is similar to that described in the foregoing section (e). It is to be noted that, in this case, a destination to which the treatment cell 8 is carried is a position on the receiving plate 41 of the workpiece collection device 4.

(h) Next, the workpiece collection device 4 is operated.

Actually, in the workpiece collection device 4 prior to the start of the operation, as shown in FIG. 11, the hopper 42 is located above the treatment cell 8 with the discharge port 423 facing upward, the gripping means 48 is in a non-gripping state, the collection vessel 45 is placed on the receiving plate 461, and the cylindrical body 462 is located at its lower limit position. Further, the treatment cell 8 is placed on the receiving plate 41.

(h-1) First, the cylinders 482 are operated, the rods 4821 are retracted, and the gripping protrusive portions 481 are fitted into the groove 89 of the treatment cell 8 placed on the receiving plate 41; as a result, the treatment cell 8 is gripped on the receiving plate 41.

(h-2) Next, the cylinders 421 are operated, the rods 4211 are retracted, and the hopper 42 is lowered; as a result, the covering portion 42A of the hopper 42 covers the treatment cell 8 from above.

(h-3) Next, the motor 432 is operated, and the horizontal rotation shaft 431 is rotated; as a result, the treatment cell 8 placed on the receiving plate 41 and the hopper 42 covering the treatment cell 8 are inverted.

At this time, since the treatment cell 8 is gripped by the gripping means 48, the treatment cell 8 can be prevented from being separated from the receiving plate 41 and collided with the covering portion 42A of the hopper 42 at the time of inversion even if there is a gap between the treatment cell 8 and the hopper 42. Accordingly, even if the treatment cell 8 to be used is replaced with the treatment cell 8 having a different height, it is possible to prevent a problem that the treatment cell 8 collides with the covering portion 42A of the hopper 42; hence, it is possible to deal with a change in the height of the treatment cell 8 without any trouble.

(h-4) Next, as shown in FIG. 12, the cylinder 463 is operated, the cylindrical body 462 is raised, and the receiving plates 466 abut against the bottom 451 of the collection vessel 45 from below to lift the collection vessel 45; as a result, the collection vessel 45 is raised to a position at which the discharge port 423 of the hopper 42 is closed. At this time, as shown in FIG. 15, the two pins 452 of the collection vessel 45 pass through the discharge port 423, and push up the lid member 42C against the spring 429; as a result, the discharge port 423 is opened.

(h-5) Next, the cleaning water supply means 44 is operated, and the cleaning water is ejected from the sprinkler 442; as a result, the workpiece and the dummy within the treatment cell 8 are washed out by the cleaning water, and flow down from the discharge port 423 of the hopper 42 into the collection vessel 45.

At this time, the workpiece and the dummy flowing out from the treatment cell 8 also fall down on the lid member 42C of the hopper 42; however, the inner portion 420 of the lid member 42C has a conical shape, and therefore, the workpiece and the dummy smoothly flow down along the surface of the lid member 42C. Accordingly, the workpiece and the dummy can be prevented from being adhered to the lid member 42C and from remaining in the hopper 42. Moreover, since the lid member 42C is provided within the hopper 42, the lid member 42C is exposed to the cleaning water ejected from the sprinkler 442. Accordingly, also in this respect, the workpiece and the dummy can be prevented from being adhered to the lid member 42C and from remaining in the hopper 42.

(h-6) Then, the workpiece and the dummy, which have flowed out from the discharge port 423 of the hopper 42 together with the cleaning water, are filtered out by the filter member constituting the bottom 451 of the collection vessel 45. On the other hand, the cleaning water goes through the bottom 451 of the collection vessel 45, flows within the cylindrical body 462, and is accumulated in the collection tank 47. Thus, the workpiece and the dummy are collected by the collection vessel 45.

At this time, the cleaning water, which has flowed out from the discharge port 423 of the hopper 42, goes through the collection vessel 45, flows within the cylindrical body 462, and flows into the collection tank 47; therefore, the collection vessel 45 and the cylindrical body 462 both serve to prevent the scattering of the cleaning water. Accordingly, the scattering of the cleaning water can be prevented with certainty.

(h-7) When the collection of the workpiece and the dummy has been finished, the operation of the cleaning water supply means 44 is stopped; then, the cylinder 463 is operated, and the cylindrical body 462 is lowered to its lower limit position. Next, the inverting means 43 is operated, and the treatment cell 8 placed on the receiving plate 41 and the hopper 42 covering the treatment cell 8 are inverted. Subsequently, the cylinders 421 are operated, the hopper 42 is raised to its upper limit position, and then the gripping means 48 enters the non-gripping state.

(i) Then, the drying device 5 is operated.

Actually, in the drying device 5 prior to the start of the operation, the gripping means 51A is located at its upper limit position above the receiving plate 52, the pair of gripping arms 511 has a maximum opposing interval, and the upper hood portion 531 is closed.

(i-1) First, the transportation means 51 is operated, and the collection vessel 45 is transported from the workpiece collection device 4 to a position above the receiving plate 52. More specifically, first, the cylinder 517 of the moving means 51C is operated, and the gripping means 51A is moved toward an X1 direction of FIG. 2; as a result, the gripping means 51A is located at a position above the collection vessel 45 of the workpiece collection device 4. Next, the cylinder 515 of the raising and lowering means 51B is operated, and the gripping means 51A is lowered; as a result, the gripping plates 5111 are each located at a position below the flange 453 of the collection vessel 45. Then, the cylinder 512 of the gripping means 51A is operated, and the opposing interval between the pair of gripping arms 511 is decreased; as a result, the gripping plates 5111 are each located immediately below the flange 453 of the collection vessel 45. Subsequently, the cylinder 515 of the raising and lowering means 51B is operated, and the gripping means 51A is raised; thus, the gripping plates 5111 abut against the flange 453 of the collection vessel 45 from below to lift the collection vessel 45 to its upper limit position. At this time, the pins 5112 of the gripping plates 5111 are fitted into the cut-outs 454 of the flange 453.

(i-2) Next, the cylinder 536 of the opening/closing means 533 is operated, and the upper hood portion 531 is opened.

(i-3) Next, the transportation means 51 is operated, and the collection vessel 45 is placed on the receiving plate 52. More specifically, first, the cylinder 517 of the moving means 51C is operated, and the gripping means 51A is moved toward an X2 direction of FIG. 2; as a result, the gripped collection vessel 45 is located above the receiving plate 52. Then, the cylinder 515 of the raising and lowering means 51B is operated, and the gripping means 51A is lowered; thus, the gripped collection vessel 45 is placed on the receiving plate 52, and furthermore, the gripping plates 5111 are each located immediately below the flange 453 of the collection vessel 45. At this time, the pins 455 of the collection vessel 45 are fitted into the receiving portions 522 of the receiving plate 52. Then, the cylinder 512 of the gripping means 51A is operated, and the opposing interval between the pair of gripping arms 511 is increased; as a result, the gripping plates 5111 are each located at a position laterally away from the position immediately below the flange 453 of the collection vessel 45. Subsequently, the cylinder 515 of the raising and lowering means 51B is operated, and the gripping means 51A is raised; as a result, the gripping means 51A is located at its upper limit position above the receiving plate 52. Then, the cylinder 517 of the moving means 51C is operated, and the gripping means 51A is moved toward the X1 direction of FIG. 2; as a result, the gripping means 51A recedes from the position above the receiving plate 52.

(i-4) Next, the cylinder 536 of the opening/closing means 533 is operated, and the upper hood portion 531 is closed.

(i-5) Next, the air supply and exhaust means 54 is operated. More specifically, air is delivered from the blower, goes through the supply pipe 542 so as to be supplied to the inside of the upper hood portion 531, passes through the bottom 451 of the collection vessel 45 and the through hole 521, goes through the lower hood portion 532, and is then exhausted from the exhaust pipe 543. At this time, the workpiece and the dummy within the collection vessel 45 are dried because they are exposed to the air passing through the collection vessel 45. On the other hand, moisture produced by the drying is exhausted from the exhaust port 538. The air delivered from the blower has, for example, a pressure of 1 to 14 kPa, an air volume of 1 to 3 $m^3$/min, and a temperature of 0 to 300° C.

At this time, the air, which has been supplied to the inside of the upper hood portion 531, inevitably passes through the collection vessel 45. Accordingly, the workpiece and the dummy within the collection vessel 45 can be dried with certainty. Further, since the air passes through the collection vessel 45 from the top to the bottom, the workpiece and the dummy are pressed downward. Accordingly, the scattering of the workpiece and the dummy can be prevented. Moreover, the air is not directly blown on the inside of the collection vessel 45, but is flowed into the collection vessel 45 after having been supplied laterally to the inside of the upper hood portion 531 and diffused. Accordingly, the scattering of the workpiece and the dummy due to the wind pressure of the air can be prevented. Furthermore, since the produced moisture is exhausted from the exhaust port 538 located at the lowermost position within the lower hood portion 532, the scattering of the moisture due to the air passing therethrough can be prevented.

(i-6) When the drying process has been finished, the cylinder 536 of the opening/closing means 533 is operated, and the upper hood portion 531 is opened.

(i-7) Next, the operator picks up the collection vessel 45 from the receiving plate 52, takes out the workpiece and the dummy from the collection vessel 45, and then returns the collection vessel 45 onto the receiving plate 52. At this time, the pins 455 of the collection vessel 45 are fitted into the receiving portions 522 of the receiving plate 52.

(i-8) Then, the transportation means 51 is operated in a manner contrary to that described above, and the collection vessel 45 on the receiving plate 52 is transported and placed on the receiving plate 41 of the workpiece collection device 4.

At this time, the positioning of the collection vessel 45 is defined because the pins 5112 of the gripping plates 5111 are fitted into the cut-outs 454 of the flange 453. Thus, the collection vessel 45 placed on the receiving plate 41 of the workpiece collection device 4 is secured in a state in which the pins 452 can push up the lid member 42C of the hopper 42.

In the drying device 5 with the above-described structure, the collection vessel 45 is shared with the workpiece collection device 4, and therefore, it is possible to save the trouble of transferring the workpiece and the dummy between the workpiece collection device 4 and the drying device 5.

(j) It should be noted that, in the surface treatment apparatus 1 with the above-described structure prior to the start of the operation, the first treatment cell 8 is set in the first surface treatment device 3, and the second treatment cell 8 is set in the workpiece collection device 4. Then, the first treatment cell 8 is handled as described in the foregoing sections (d) to (h), but the second treatment cell 8 is handled as follows.

Specifically, when the first treatment cell 8 is used in the second surface treatment device 3, the second treatment cell 8 is carried from the workpiece collection device 4 to the first surface treatment device 3 by the carrying device 6. Then, similarly to the first treatment cell 8, the second treatment cell 8 is handled as described in the foregoing sections (d) to (h). It should be noted that the workpiece and the dummy, which are to be processed by the second treatment cell 8, are introduced into the supply device 2 in advance by the operator.

On the other hand, when the first treatment cell 8 has been handled as described in the foregoing sections (d) to (h) and the use of the first treatment cell 8 in the workpiece collection device 4 has been finished, the first treatment cell 8 is handled similarly to the second treatment cell 8.

Thus, the first treatment cell 8 and the second treatment cell 8 are used repeatedly in parallel.

(C) Modified Structure

The surface treatment apparatus 1 with the above-described structure may adopt any of the following modified structures.

(i) No dummy is used. That is, the single shooter is provided.

(ii) The three or more shooters are provided.

(iii) The single surface treatment apparatus 1 is provided, or the three or more surface treatment apparatuses 1 are provided.

Figure 19:
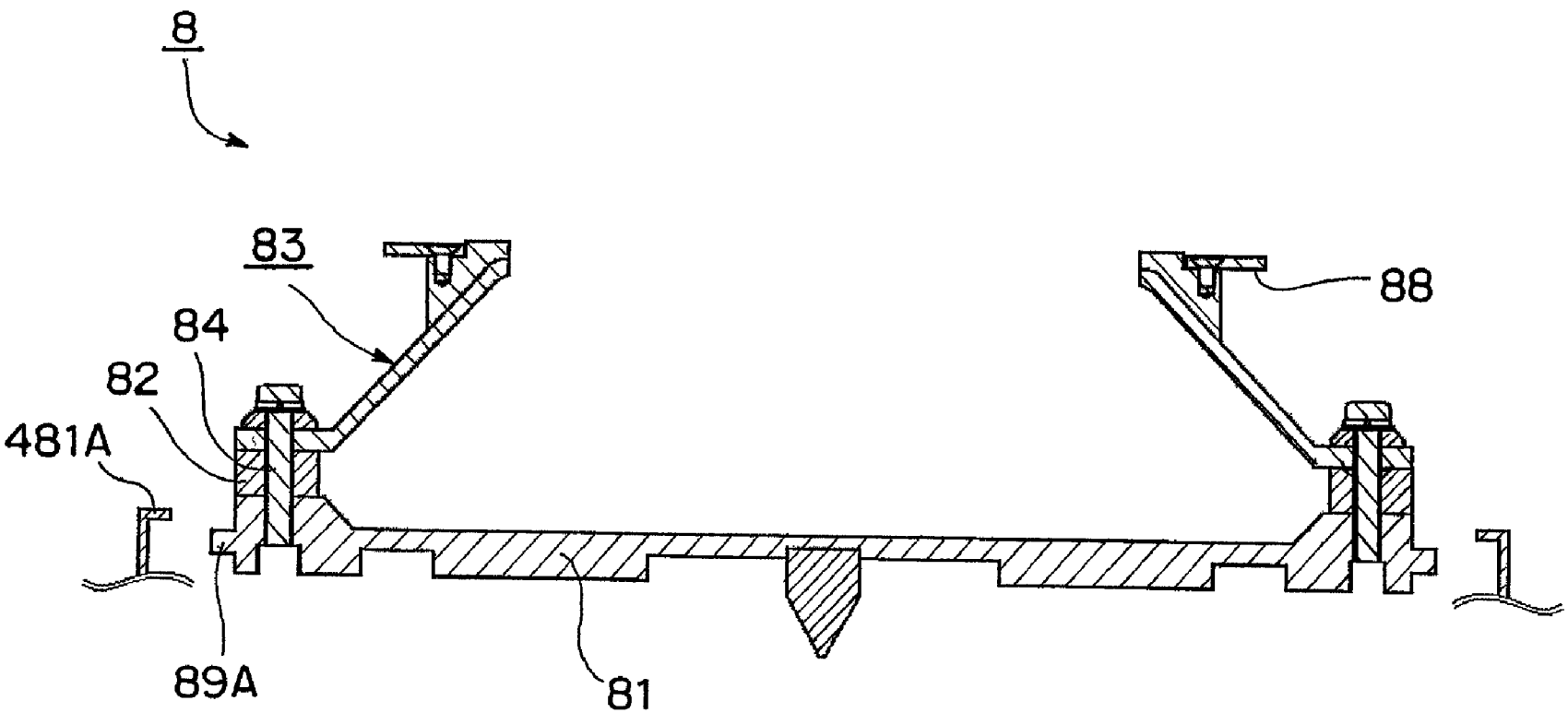
FIG. 19 is a longitudinal cross-sectional view showing a modified structure of the treatment cell.

(iv) As shown in FIG. 19, the treatment cell 8 has, at a peripheral surface of the bottom plate 81, a circumferentially continuous protrusive portion 89A instead of the groove 89. In this case, the gripping means 48 of the workpiece collection device 4 has an abutment portion 481A that abuts against the protrusive portion 89A from above. Alternatively, the gripping means 48 has a gripping portion for gripping the protrusive portion 89A from above and below. Also in this structure, the same operating effects as those in the case where the groove 89 and the gripping protrusive portions 481 are provided can be achieved.

(v) No surface treatment liquid is contained in the positive electrode retaining tank 36G of the surface treatment device 3. In this case, the positive electrode 360 can be cleaned within the positive electrode retaining tank 36G; thus, the surface treatment liquid adhered to the positive electrode 360 can be prevented from being dried and crystallized, and the dried and crystallized surface treatment liquid is prevented from being mingled with the surface treatment liquid.

(vi) The positive electrode retaining tank 36G consists of a concave portion formed at a surface of the partition plate 71. In this structure, the structure of the positive electrode retaining tank 36G can be simplified.

(vii) A vibration means for vibrating the pot 26 is provided. In this structure, the workpiece and the dummy can be discharged from the pot 26 with ease and certainty.

Figure 20:
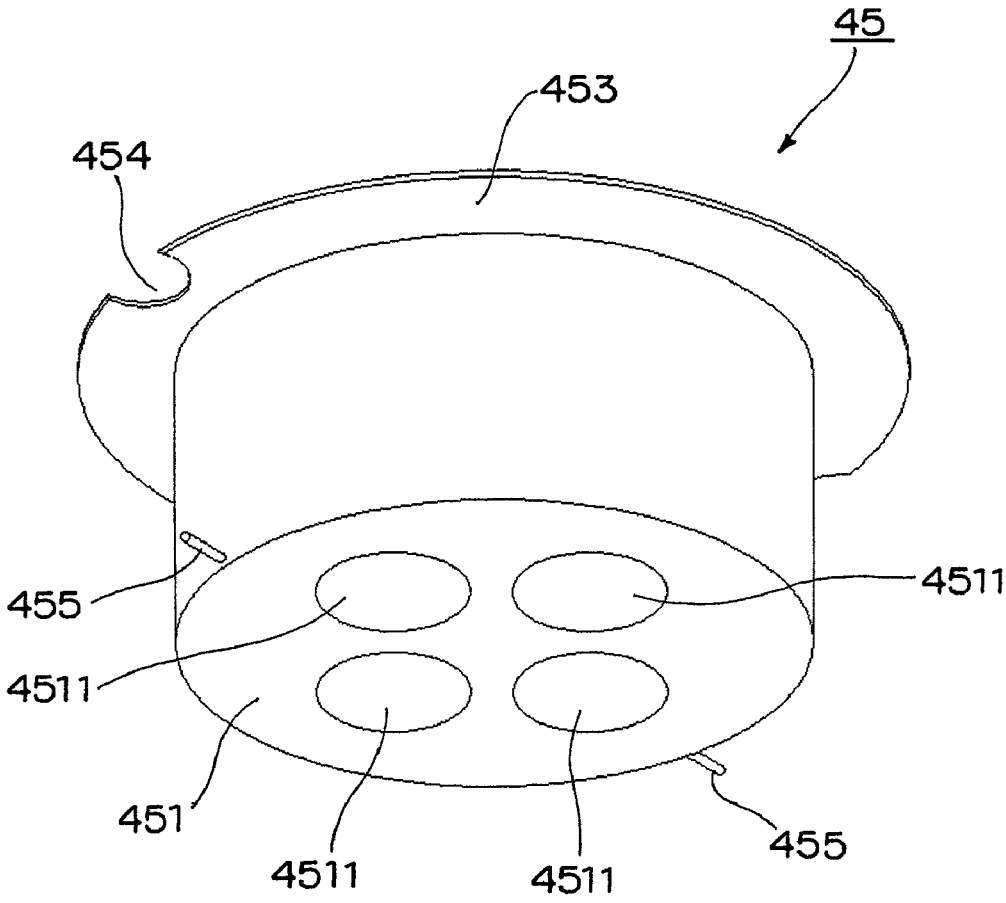
FIG. 20 is a bottom perspective view showing a modified structure of the collection vessel.

(viii) As shown in FIG. 20, the filter member constituting the bottom 451 of the collection vessel 45 has a plurality of openings 4511. The openings 4511 each have a size through which the workpiece and the dummy cannot pass. Alternatively, the filter member constituting the bottom 451 of the collection vessel 45 is a porous plate in which a large number of punched holes are formed, or a porous plate having a large number of bubbles. The punched holes and the bubbles each have a size through which the workpiece and the dummy cannot pass.

Figure 21:
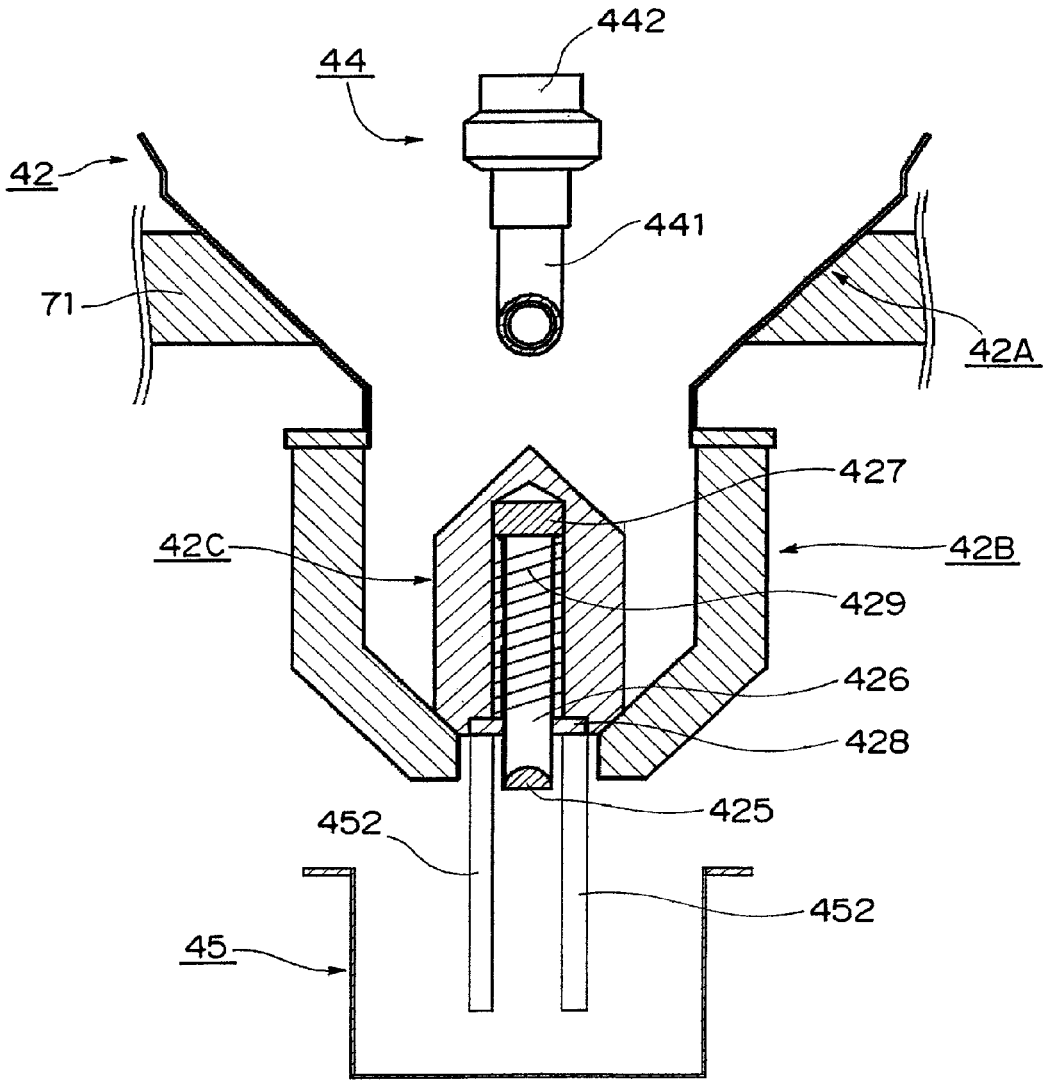
FIG. 21 is a partial longitudinal cross-sectional view showing a modified structure of the workpiece collection device.

(ix) In the workpiece collection device 4, the two pins 452 are provided not at the collection vessel 45 but at the lid member 42C as shown in FIG. 21. In this case, upon raising of the collection vessel 45, the bottom 451 of the collection vessel 45 abuts against lower ends of the two pins 452 to lift the lid member 42C.

(x) Air used for drying in the drying device 5 is hot air. In this case, the drying efficiency can be improved.

(xi) Air used for drying in the drying device 5 is pressurized air or depressurized air. In this case, the drying efficiency can be improved.

(xii) The carrying device 6 has the following structure. Specifically, the carrying device 6 includes: a gripping means 61 for gripping the treatment cell 8; a back-and-forth moving means 63 for moving the gripping means 61 back and forth; a raising and lowering means 62 for vertically moving the entire back-and-forth moving means 63; and a lateral moving means 64 for laterally moving the entire back-and-forth moving means 63 and the entire raising and lowering means 62. To be more specific, referring to FIG. 18, in this carrying device 6, the gripping means 61 is fixed to the plate member 632 of the back-and-forth moving means 63, and the raising and lowering means 62 is provided between the horizontal rails 631 of the back-and-forth moving means 63 and the frame body 642. More specifically, the cylinders 612 of the gripping means 61 are fixed to the plate member 632, the vertical cylinder 621 of the raising and lowering means 62 is fixed to the horizontal rails 631, and the upper end of the rod 622 is fixed to the frame body 642.

In this carrying device 6, the treatment cell 8 is gripped by the gripping means 61, moved backward by the back-and-forth moving means 63, lifted by the raising and lowering means 62, moved to the back of the subsequent device by the lateral moving means 64, lowered by the raising and lowering means 62, moved forward by the back-and-forth moving means 63, and then released from the gripping of the gripping means 61 so as to be disposed in the subsequent device. Also in this carrying device 6, the same effects as those of the carrying device 6 of the foregoing embodiment can be achieved.

[Industrial Applicability]

The surface treatment apparatus 1 of the present invention is capable of automatically carrying a workpiece, which has been introduced into a supply device by an operator, to a surface treatment device, a workpiece collection device, and a drying device in sequence so as to obtain the surface-treated and dried workpiece, and is therefore industrially very useful.

What is claimed is:

1. A drying device for exposing a workpiece contained in a collection vessel to air, thereby drying the workpiece, wherein the drying device comprises:

a receiving plate on which the collection vessel is placed;

a hood for hermetically closing, from above and below, the collection vessel placed on the receiving plate; and air supply and exhaust means for supplying air to and exhausting air from the inside of the hood, wherein the receiving plate has a through hole at its portion that faces a filter member constituting a bottom of the collection vessel, and wherein the air supply and exhaust means has: a blower for delivering air; a supply pipe through which air from the blower is supplied to a region located above the receiving plate; and an exhaust pipe through which air is exhausted from below the receiving plate, wherein the air supply and exhaust means is configured to supply air laterally to above the collection vessel through the supply pipe and is configured to exhaust air passed through the bottom of the collection vessel and the through hole of the receiving plate from the top to the bottom.

* * * * *